US011827014B2

(12) United States Patent
Shiobara et al.

(10) Patent No.: US 11,827,014 B2
(45) Date of Patent: Nov. 28, 2023

(54) PRINTING SYSTEM WITH RELAY TRANSPORTATION UNIT FOR TRANSPORT PATH SWITCHING

(71) Applicant: Seiko Epson Corporation, Tokyo (JP)

(72) Inventors: Hiroshi Shiobara, Matsumoto (JP); Namiki Hashiguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/660,493

(22) Filed: Apr. 25, 2022

(65) Prior Publication Data

US 2022/0339950 A1 Oct. 27, 2022

(30) Foreign Application Priority Data

Apr. 26, 2021 (JP) ..... 2021-073789

(51) Int. Cl.

| | |
|---|---|
| ***B41J 11/42*** | (2006.01) |
| ***B41J 13/00*** | (2006.01) |
| ***B65H 29/60*** | (2006.01) |
| *B41J 13/10* | (2006.01) |

(52) U.S. Cl.

CPC ..... *B41J 11/42* (2013.01); *B41J 13/009* (2013.01); *B41J 13/0036* (2013.01); *B65H 29/60* (2013.01); *B41J 13/106* (2013.01)

(58) Field of Classification Search

CPC ..... B41J 11/42; B41J 11/485; B65H 29/58; B65H 29/60; B65H 29/62; B65H 29/64; B65H 29/585; B65H 2301/31; B65H 2301/16

See application file for complete search history.

(56) References Cited

U.S. PATENT DOCUMENTS

| | | | | |
|---|---|---|---|---|
| 6,328,298 | B1 * | 12/2001 | Suzuki | B42C 1/12 270/58.08 |
| 2013/0083367 | A1 * | 4/2013 | Hara | H04N 1/40 271/225 |
| 2015/0307310 | A1 | 10/2015 | Miyake et al. | |
| 2017/0157953 | A1 * | 6/2017 | Kodama | B41J 2/01 |

FOREIGN PATENT DOCUMENTS

| | | |
|---|---|---|
| JP | 2015-209316 | 11/2015 |

* cited by examiner

*Primary Examiner* — Henok D Legesse
(74) *Attorney, Agent, or Firm* — WORKMAN NYDEGGER

(57) ABSTRACT

A printing system includes a discharging unit, a mounting unit, a post-process unit, a relay unit, and a control unit. The discharging unit discharges sheets. The mounting unit is provided to an apparatus body, and sheets are mounted on the mounting unit. The post-process unit performs a post-process on sheets. The relay unit is provided to the apparatus body, is configured to transport sheets to the post-process unit, and includes a lower path member. The lower path member is configured to be switched between a first state in which the lower path member serves as part of a relay path from the discharging unit to the post-process unit and a second state in which the lower path member opens the relay path. The control unit, when the lower path member is in the second state, makes sheets be discharged from the discharging unit to the mounting unit.

14 Claims, 19 Drawing Sheets

PRINTING SYSTEM WITH RELAY TRANSPORTATION UNIT FOR TRANSPORT PATH SWITCHING

The present application is based on, and claims priority from JP Application Serial Number 2021-073789, filed Apr. 26, 2021, the disclosure of which is hereby incorporated by reference herein in its entirety.

BACKGROUND

1. Technical Field

The present disclosure relates to a printing system.

2. Related Art

The bookbinding system of JP-A-2015-209316 has a transportation unit between an image forming apparatus and a bookbinding apparatus. The transportation unit has an escape tray for turning sheets aside when bookbinding operation in the bookbinding apparatus cannot continues.

In a printing system having a post-process unit after printing such as the configuration of JP-A-2015-209316, in order to prevent a decrease in the productivity when the post-process unit becomes inoperable, an additional sheltering apparatus is necessary to which printed media are sent in.

However, if an additional sheltering apparatus is provided between the printing unit and the post-process unit, it can make the printing system larger.

SUMMARY

A printing system according to the present disclosure to solve the above-described problem includes: a discharging unit provided to an apparatus body and configured to discharge a medium printed by a printing unit; a mounting unit provided to the apparatus body and configured to accommodate the medium discharged from the discharging unit; a post-process unit configured to perform a post-process on the medium discharged in a discharging direction from the discharging unit; a relay transportation unit that is provided to the apparatus body and configured to transport the medium discharged from the discharging unit, to the post-process unit and that has at least one switching member; and a control unit configured to control discharging of the medium from the discharging unit. Here, the switching member is configured to be switched between a first state in which the switching member serves as part of a relay path of the medium from the discharging unit to the post-process unit and a second state in which the switching member opens the relay path to the mounting unit, and the control unit, when the switching member is in the second state, makes the medium be discharged from the discharging unit to the mounting unit.

DESCRIPTION OF EXEMPLARY EMBODIMENTS

Figure 1:
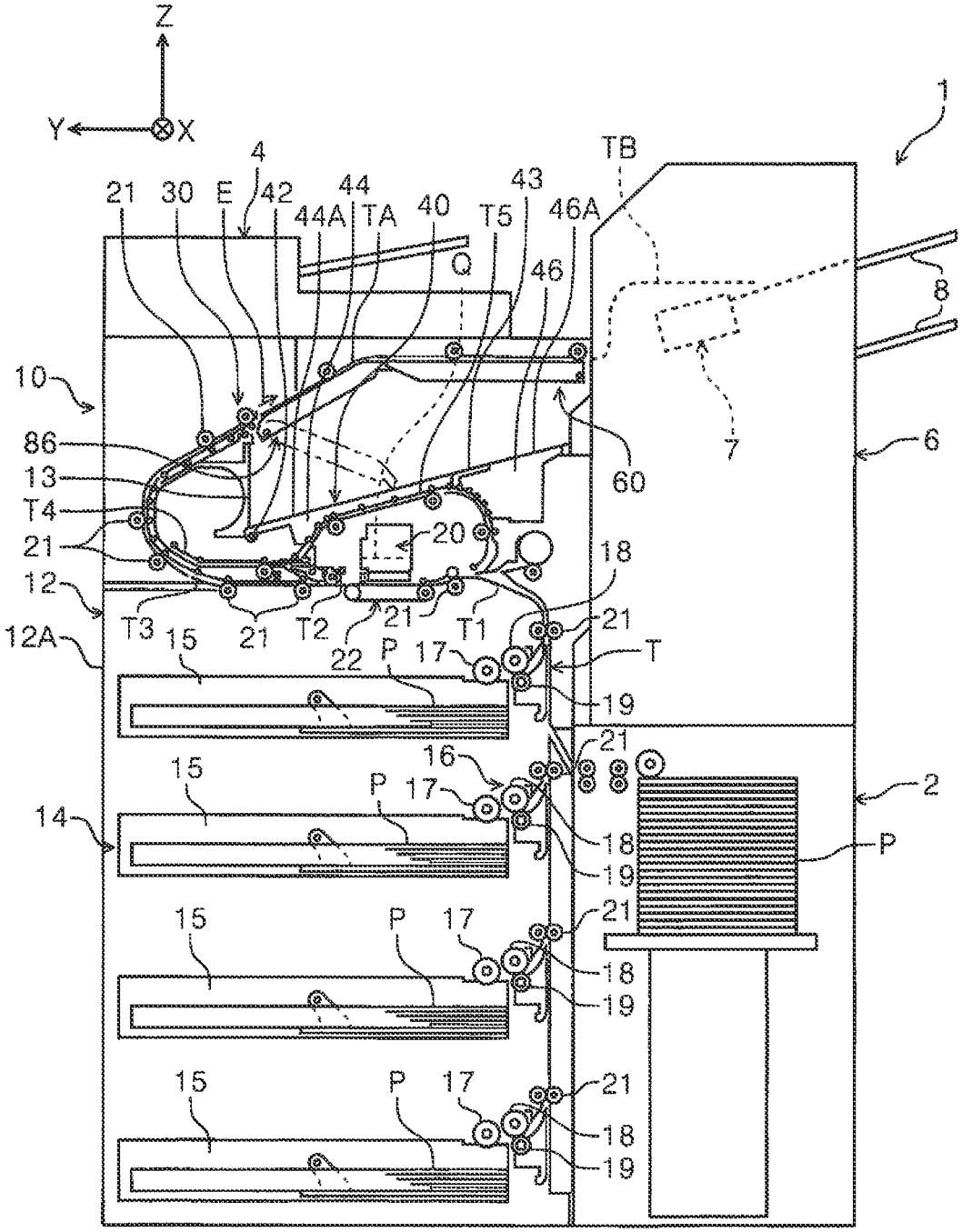
FIG. 1 is a diagram illustrating the overall configuration of a printing system according to Embodiment 1.

Hereinafter, the present disclosure will be schematically described.

A printing system of a first aspect includes: a discharging unit provided to an apparatus body and configured to discharge a medium printed by a printing unit; a mounting unit provided to the apparatus body and configured to accommodate the medium discharged from the discharging unit; a post-process unit configured to perform a post-process on the medium discharged in a discharging direction from the discharging unit; a relay transportation unit that is provided to the apparatus body and configured to transport the medium discharged from the discharging unit, to the post-process unit and that has at least one switching member; and a control unit configured to control discharging of the medium from the discharging unit, in which the switching member is configured to be switched between a first state in which the switching member serves as part of a relay path of the medium from the discharging unit to the post-process unit and a second state in which the switching member opens the relay path to the mounting unit, and the control unit, when the switching member is in the second state, makes the medium be discharged from the discharging unit to the mounting unit.

In this aspect, when the post-process unit is operable, the switching member is set in the first state. After the medium printed by the printing unit is discharged from the discharging unit in the discharging direction, the medium is transported by the relay transportation unit to the post-process unit, and post-processed in the post-process unit.

When the post-process unit is inoperable, the switching member is set in the second state, and the relay path is opened to the mounting unit. In this case, after the medium printed by the printing unit is discharged in the discharging direction from the discharging unit, the medium falls onto the mounting unit through the opened portion of the relay path and is mounted on the mounting unit.

As described above, when the post-process unit turns inoperable, the media are mounted on the mounting unit. Thus, the operation of the printing system does not need to be stopped, and this prevents a decrease in the productivity of the printing system. In addition, since the media are discharged by using the mounting unit provided to the apparatus body, it is possible to prevent an increase in the size of the printing system, compared to the configuration in which the media are discharged to an apparatus independent of the apparatus body.

In a printing system of a second aspect according to first aspect, the relay transportation unit includes an upper path member configured to serve as an upper portion, in an apparatus height direction, of the relay path, and a lower path member configured to serve as a lower portion, in the apparatus height direction, of the relay path and configured to serve as the switching member, the upper path member is provided with a rotation mechanism unit that is driven to rotate and thereby transports the medium, and the lower path member is not provided with the rotation mechanism unit.

In this aspect, since the lower path member does not have the rotation mechanism unit, when the state of the lower path member is switched to the first state or the second state, it is easy to switch the state of the lower path member, compared to the configuration in which the lower path member has the rotation mechanism unit.

In a printing system of a third aspect according to the second aspect, the relay transportation unit includes a first rotation shaft that extends in a medium width direction intersecting both the discharging direction and the apparatus height direction, the first rotation shaft supports the lower path member such that the lower path member is rotatable, and the lower path member is switched between the first state and the second state by being rotated around the first rotation shaft.

In this aspect, since the lower path member is rotated around the first rotation shaft, the movable range of the lower path member is smaller than in the configuration in which the lower path member is slid, and thus, less space is necessary for switching between the first state and the second state.

In a printing system of a fourth aspect according to the third aspect, the lower path member has a proximal end portion rotatable around the first rotation shaft, and the mounting unit is positioned outside a rotation path of a distal end portion of the lower path member which is opposite to the proximal end portion.

In this aspect, since the mounting unit does not exist within the rotation area of the lower path member, the lower path member can be rotated regardless of the arrangement of the mounting unit. With this configuration, it is possible to make the space to store the medium between the lower path member and the mounting unit, and thus it is possible to prevent a decrease in the number of the media that can be mounted on the mounting unit when the lower path member is in the second state.

In a printing system of a fifth aspect according to the third or fourth aspect, the mounting unit has a protruding portion that supports the medium mounted on the mounting unit, and the lower path member has a recessed portion configured to accommodate insertion of part of the protruding portion when the lower path member is in the second state.

In this aspect, since the mounting unit is provided with the protruding portion, and when the lower path member is in the second state, the protruding portion is inserted in the recessed portion of the lower path member, the lower path member can be positioned close to the mounting unit. In other words, the rotation range of the lower path member is less restricted by the protruding portion. With this configuration, in the case of the configuration in which the lower path member comes in contact with the mounting unit, the space formed on the mounting unit can be large.

In a printing system of a sixth aspect according to any one of third to fifth aspects, the lower path member includes a first lower path member and a second lower path member positioned downstream, in the discharging direction, of the first lower path member, the first lower path member is configured to rotate around the first rotation shaft, and the relay transportation unit is switched between the first state and the second state by the first lower path member being rotated around the first rotation shaft.

In this aspect, since the lower path member is divided into the first lower path member and the second lower path member, and the first lower path member is rotatable, when a medium transportation error occurs in the path at the lower path member, it is easy to take out the medium at the lower path member.

In a printing system of a seventh aspect according to the sixth aspect, the relay transportation unit includes a second rotation shaft that extends in the medium width direction and supports the second lower path member such that the second lower path member is rotatable, and a downstream end portion, in the discharging direction, of the second lower path member is rotatably supported by the second rotation shaft.

In this aspect, when the medium remains in the relay transportation unit due to a transportation error, the first lower path member and the second lower path member can be rotated, making a state like a double-door open state. In this case, the opened range of the relay path is wide, and thus it is easy to take the medium out of the relay transportation unit.

A printing system of an eighth aspect according to the seventh aspect further includes a detection unit configured to detect that the second lower path member is in an open state and a closed state, and the control unit, when the detection unit detects the open state, stops operation of discharging the medium by the discharging unit.

In this aspect, when the second lower path member is in the open state, the medium is not discharged from the discharging unit toward the relay transportation unit, and thus it is possible to prevent the medium from falling from the relay path on the way toward the post-process unit.

In a printing system of a ninth aspect according to the second aspect, the lower path member includes a first lower path member and a second lower path member positioned downstream, in the discharging direction, of the first lower path member, the first lower path member is configured to retreat from the relay path, and the lower path member is switched from the first state to the second state by the first lower path member being made to retreat from the relay path.

In this aspect, the lower path member is divided into the first lower path member and the second lower path member. Here, since the first lower path member can retreat from the relay path, when a medium transportation error occurs in the middle of the relay path, the medium can be taken out easily at the lower path member by making the first lower path member retreat from the relay path.

In a printing system of a tenth aspect according to any one of sixth to ninth aspects, a recess is provided at one of a downstream end, in the discharging direction, of the first lower path member and an upstream end, in the discharging direction, of the second lower path member, a protrusion configured to be inserted in the recess is provided at the other of the downstream end, in the discharging direction, of the first lower path member and the upstream end, in the discharging direction, of the second lower path member, a recess and a protrusion can move relative to each other in the apparatus height direction, and when the lower path member is in the first state, at least part of the protrusion is inserted in the recess.

In this aspect, in the first state in which at least part of the protrusion is inserted in the recess, the medium being transported by the relay transportation unit is supported at any position in the discharging direction by at least one of the first lower path member and the second lower path member. This configuration prevents medium transportation errors in the relay transportation unit, compared to the configuration in which the first lower path member and the second lower path member do not overlap in the discharging direction, when viewed from the medium width direction.

Further, since the recess and the protrusion can move relative to each other in the apparatus height direction, no matter which of the first lower path member and the second lower path member is made to retreat first from the relay path, it is possible to prevent interference between the first lower path member and the second lower path member.

In a printing system of an eleventh aspect according to any one of the second to tenth aspects, the discharging unit includes a gently-bending unit configured to perform gently-bending operation in which the medium is deformed such that a shape of the medium is in a wavy form viewed from the discharging direction, the gently-bending unit being configured to switch whether to perform the gently-bending operation, and the gently-bending unit, when the lower path member is in the first state, does not perform the gently-bending operation on the medium and, when the lower path member is in the second state, performs the gently-bending operation on the medium.

In this aspect, when the lower path member is in the first state, since the medium entering the path at the lower path member is not gently bent, it easy for the relay transportation unit to transport the medium.

In contrast, when the lower path member is in the second state, the gently-bending unit performs the gently-bending operation on the medium entering the path at the lower path member, and this increases the rigidity of the medium against a force acting the discharging direction, it is possible to prevent a decrease in the medium stacking property that would be caused by the medium curling in the mounting unit.

In a printing system of a twelfth aspect according to the second to eleventh aspects, the discharging unit includes a guide member configured to guide the medium in the discharging direction, and when a straight line extending from a distal end, in the discharging direction, of the guide member to the discharging direction is defined as an imaginary line, the lower path member is positioned lower than the imaginary line in an orthogonal direction orthogonal to the discharging direction.

In this aspect, when the medium is discharged from the discharging unit, the lower path member is not positioned higher in the orthogonal direction than the distal end of the guide member, and thus it is possible to prevent medium transportation errors that would be caused by the leading end of the medium being caught by the lower path member.

In a printing system of a thirteenth according to any one of the first to twelfth aspects, an upstream end portion, in the discharging direction, of the switching member has a supporting portion that supports the medium, the supporting portion, when the switching member is in the second state, protrudes upward in an apparatus height direction of the apparatus body, and the control unit, when the switching member is in the first state, makes the discharging unit discharge the medium at a first speed and, when the switching member is in the second state, makes the discharging unit discharge the medium at a second speed higher than the first speed.

In this aspect, when the switching member is in the first state, the medium is discharged to the relay transportation unit at the first speed. When the switching member is in the second state, there is a possibility that the movement of the medium may be restricted by the supporting portion.

Here, in this aspect, when the switching member is in the second state, the medium is discharged from the discharging unit at the second speed which is higher than the first speed, and thus accelerated. The accelerated medium goes over the supporting portion and falls onto the mounting unit. With this configuration, it is possible to reduce media discharge errors, compared to the configuration in which the discharge speed of the medium is not changed.

A printing system of a fourteenth according to the first to thirteenth aspects further includes a determination unit configured to determine whether a size, in the discharging direction, of the medium is a size mountable on the mounting unit, in which the control unit, when the determination unit determines that the medium is mountable, makes the discharging unit discharge the medium and, when the determination unit that the medium is not mountable, stops transportation of the medium in the discharging unit.

In this aspect, when the determination unit determines that the size in the discharging direction of the medium is a size that cannot be mounted on the mounting unit, the medium having the size that cannot be mounted will not be discharged onto the mounting unit. With this configuration, it is possible to prevent the downstream end in the discharging direction of the medium from going over the mounting unit, coming into contact with the post-process unit or the like, and being deformed.

Embodiment 1

Hereinafter, a printing system 1 according to Embodiment 1 will be specifically described as an example of an embodiment of the present disclosure.

As illustrated in FIG. 1, the printing system 1 includes, as an example, a feeding unit 2, a printer unit 10, a scanner unit 4, a relay unit 60, and a post-process unit 6. The printing system 1 is an ink jet printing system that performs printing by ejecting ink Q, which is an example of liquid, onto sheets P, which are an example of media. Note that the X-Y-Z coordinate system in each figure is a Cartesian coordinate system.

The X direction is an example of an apparatus depth direction viewed from a not-illustrated operator that operates the printing system 1 and is a horizontal direction. The X direction is also an example of the medium width direction intersecting both the transportation direction and the discharging direction of sheets P. The X direction to the far side is defined as the +X direction, and the X direction to the near side the −X direction.

The Y direction is an example of the apparatus width direction viewed from the operator and is a horizontal direction. The Y direction to the left is defined as the +Y direction, and the Y direction to the right the −Y direction.

The Z direction is an example of the apparatus height direction and is the vertical direction. The upward Z direction is defined as the +Z direction, and the downward Z direction the −Z direction.

When it is not necessary to distinguish a +direction and a −direction in each direction, the direction is simply stated as the X direction, the Y direction, or the Z direction.

The feeding unit 2 stores sheets P. The sheets P stored in the feeding unit 2 are fed to the printer unit 10.

The printer unit 10 is located in the −Y direction relative to the feeding unit 2. The printer unit 10 includes a discharging unit 30, a mounting unit 40, and the relay unit 60, which are described later. Details of the printer unit 10 will be described later.

The scanner unit 4 is, as an example, attached to an end portion in the +Z direction of the printer unit 10. The scanner unit 4 reads information written on not-illustrated original documents.

The relay unit 60 is located at an end portion in the +Z direction of the printer unit 10 and a portion in the −Z direction relative to the scanner unit 4. Details of the relay unit 60 will be described later.

The post-process unit 6 is an example of a post-process unit that performs post-processes on sheets P discharged in the discharging direction from the discharging unit 30. The post-process unit 6 is provided at a position in the +Z direction relative to the feeding unit 2 and in the −Y direction relative to the printer unit 10. Specifically, the post-process unit 6 is located downstream of the discharging unit 30 in the discharging direction of sheets P. The post-process unit 6 has a path TB through which the sheets P sent from the printer unit 10 are transported. At a downstream portion of the path TB are provided a stapler 7 and a tray 8.

The stapler 7 performs, as an example of a post-process, a stapling process for stapling a specified number of sheets P. A bundle of stapled sheets P is discharged to the tray 8. Note that post-processes on sheets P include a punching process for making punched holes in sheets P, a folding process for folding a bundle of sheets P, a cutting process for cutting sheets P, a signature process for folding sheets P for binding, and a bookbinding process for bookbinding sheets P.

The printer unit 10 includes, as an example, an apparatus body 12, a sheet storage unit 14 that stores sheets P, a sheet transportation unit 16 that transports sheets P, a printing unit 20 that performs printing on sheets P, the discharging unit 30 that discharges sheets P, the mounting unit 40 on which discharged sheets P are mounted, and the relay unit 60 that transports sheets P. In the following description, as an example of the discharging direction, the discharging direction in which the discharging unit 30 discharges sheets P is defined as the E direction, which is indicated by arrow E.

Figure 2:
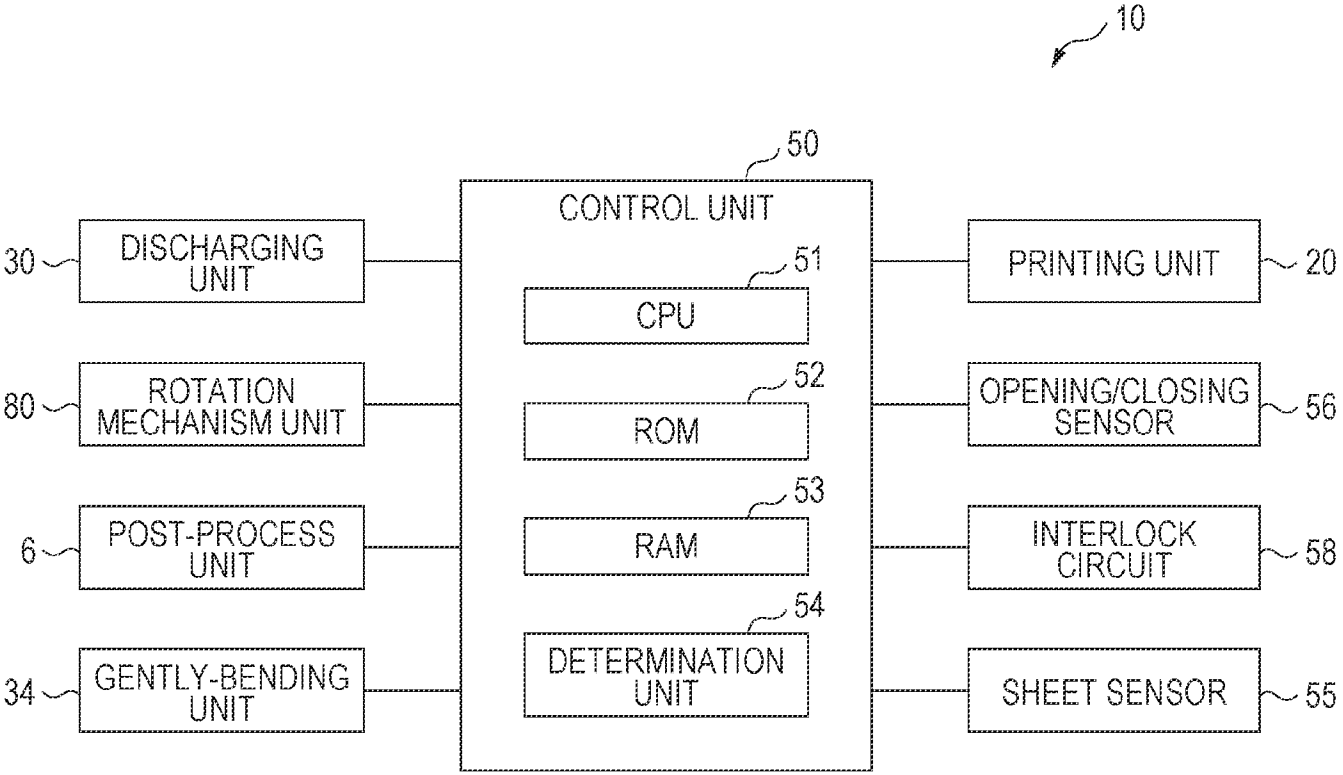
FIG. 2 is a block diagram of the printing system according to Embodiment 1.

As illustrated in FIG. 2, the printer unit 10 further includes a control unit 50, a gently-bending unit 34, a sheet sensor 55, an opening/closing sensor 56, an interlock circuit 58, and a rotation mechanism unit 80. The gently-bending unit 34, the opening/closing sensor 56, the interlock circuit 58, and the rotation mechanism unit 80 will be described later.

The control unit 50 includes a central processing unit (CPU) 51, read only memory (ROM) 52, random access memory (RAM) 53, a not-illustrated storage, and a determination unit 54. The control unit 50 controls transportation operation for sheets P in the printer unit 10, discharging operation for sheets P from the discharging unit 30 which is described later, and operation of other units including the printing unit 20 and the relay unit 60.

The sheet sensor 55 is, as an example, provided upstream of the printing unit 20 on the transportation path T (FIG. 1) described later. The sheet sensor 55 is, as an example, an optical sensor capable of measuring the time for which light is interrupted by a sheet P. The time information measured by the sheet sensor 55 is transmitted to the determination unit 54.

The determination unit 54 recognizes, based on the time information transmitted from the sheet sensor 55 and information on the transportation speed of the sheet P set in advance in the determination unit 54, the size of the sheet P being transported. Then, the determination unit 54 compares the size of the mounting unit 40 (FIG. 1) set in advance and the size of the sheet P being transported to determine whether the size in the E direction of the sheet P is a size that can be mounted on the mounting unit 40 described later.

If the sheet size in the E direction that can be mounted on the mounting unit 40 is different between the first state and the second state of a first lower path member 92 which is described later, the above determination criteria may be switched depending on the state of the first lower path member 92.

Figure 3:
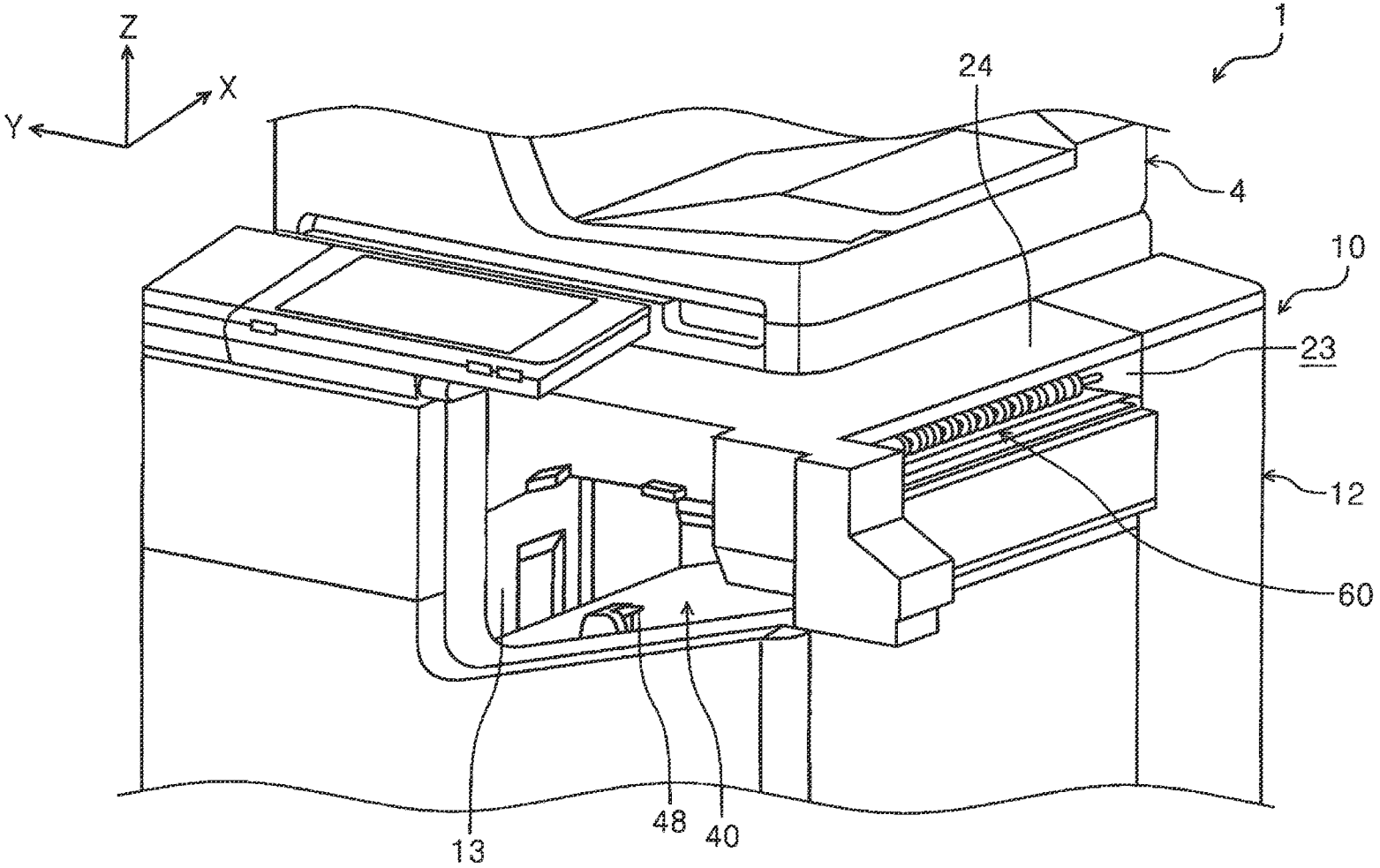
FIG. 3 is a perspective view of part of the printing system according to Embodiment 1.

As illustrated in FIG. 1, the apparatus body 12 includes a housing 12A serving as an outer case of the printer unit 10 and a not-illustrated frame member. At a position in the +Y direction and in the +Z direction relative to the center portion of the apparatus body 12 is provided a vertical wall 13 (FIG. 3).

The vertical wall 13 is a wall portion standing upright in the +Z direction at an end portion in the +Y direction of the mounting unit 40. At an end portion in the +Z direction of the vertical wall 13 is provided an opening 13A (FIG. 5) for disposing part of the relay unit 60 described later.

The sheet storage unit 14 is provided at a portion in the −Z direction relative to the center in the Z direction of the apparatus body 12. The sheet storage unit 14 has, as an example, four sheet cassettes 15.

The sheet transportation unit 16 is provided to the apparatus body 12. The sheet transportation unit 16 includes, as an example, pickup rollers 17, paper feeding rollers 18, separation rollers 19, pluralities of transportation rollers 21, a belt unit 22, and a not-illustrated motor. The sheet transportation unit 16 serves as the transportation path T through which sheets P are transported.

The transportation path T includes, as an example, a feeding path T1, a straight path T2, a discharge path T3, a switch-back path T4, and an inversion path T5. Part of the inversion path T5 is provided at a position in the +Z direction relative to the printing unit 20 described later and in the −Z direction relative to the mounting unit 40. Part of the inversion path T5 can be opened by rotating the mounting unit 40.

A sheet P in the sheet storage unit 14 is sent out to the transportation path T by the rotation of a pickup roller 17 and a paper feeding roller 18 while being separated one sheet by one sheet by a separation roller 19. A plurality of transportation rollers 21 and the belt unit 22 transports the separated sheet P toward the printing unit 20 in the transportation direction and then transports the printed sheet P to the discharging unit 30. The rotation of each roller is driven by the not-illustrated motor.

The printing unit 20 is, as an example, a line head that faces the belt unit 22. The printing unit 20 has a plurality of not-illustrated nozzles arranged to cover the entire area in the X direction of the sheet P. The printing unit 20 performs printing on the sheet P by ejecting ink Q supplied from a not-illustrated ink tank onto the sheet P through a plurality of nozzles.

The discharging unit 30 is provided to the apparatus body 12. The discharging unit 30 discharges the sheet P on which printing has been performed by the printing unit 20 to the relay unit 60 or the mounting unit 40 which is described later. The discharging unit 30 includes, as an example, a pair of discharging rollers 31, a discharging guide 32 and the gently-bending unit 34 (FIG. 4).

Figure 4:
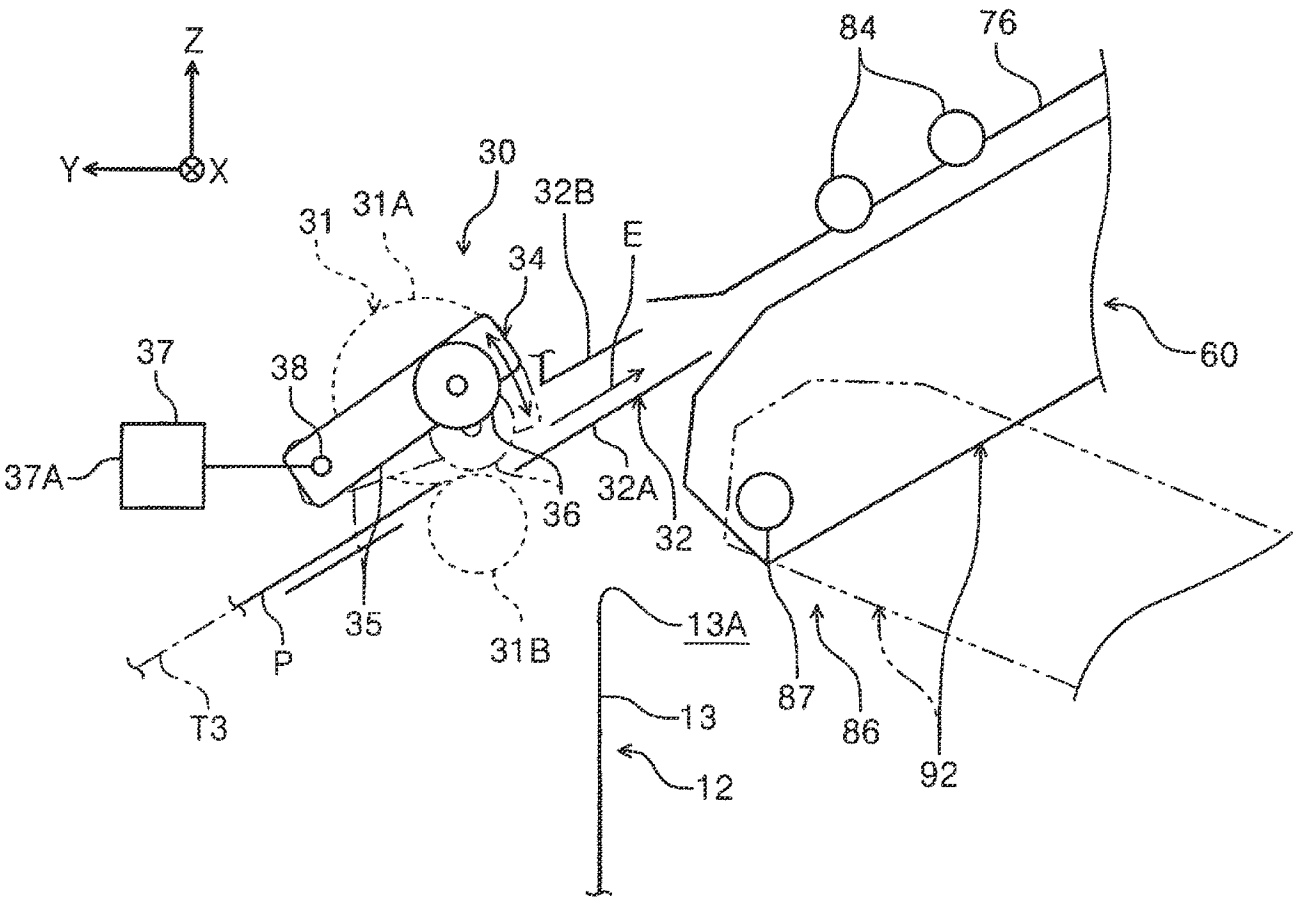
FIG. 4 is an enlarged schematic diagram of a discharging unit and the peripheries of the discharging unit in the printing system according to Embodiment 1.

As illustrated in FIG. 4, the pair of discharging rollers 31 are rotatable on rotation shafts extending along the X direction. The pair of discharging rollers 31 include a drive roller 31A that is rotated by a not-illustrated motor and a driven roller 31B that is rotated along with the rotation of the drive roller 31A. Note that the pair of discharging rollers 31 are indicated by dashed lines. Whether the drive roller 31A rotates or not is determined by the control unit 50 (FIG. 2) based on the determination result by the determination unit 54 (FIG. 2) about the size of the sheet P.

Specifically, when the determination unit 54 determines that a sheet P can be mounted on the mounting unit 40 (FIG. 1), the control unit 50 makes the discharging unit 30 discharge the sheet P. When the determination unit 54 determines that a sheet P cannot be mounted on the mounting unit 40, the control unit 50 does not make the discharging unit 30 discharge the sheet P. When the discharging unit 30 does not discharge the sheet P, the control unit 50 stops transportation of the sheet P on the transportation path T (FIG. 1).

The control unit 50, when a lower path member 86 which is described later is in a first state, makes the discharging unit 30 discharges the sheet P at a first speed V1 [mm/sec]. When the lower path member 86 is in a second state described later, the control unit 50 makes the discharging unit 30 discharge the sheet P at a second speed V2 [mm/sec]. The second speed V2 is higher than the first speed V1. Note that illustration of the first speed V1 and the second speed V2 is omitted. The control unit 50, when the lower path member 86 is in the second state, makes the discharging unit 30 discharge the sheet P to the mounting unit 40.

The discharging guide 32 is provided downstream of the nipping position of the pair of discharging rollers 31 in the E direction of the sheet P. The discharging guide 32 has, as an example, a lower wall portion 32A and an upper wall portion 32B. The discharging guide 32 is an example of a guide member for guiding the sheet P in the E direction.

The length in the X direction of the lower wall portion 32A is longer than the length in the X direction of the sheet P. The lower wall portion 32A is inclined such that the end portion in the −Y direction is positioned in the +Z direction relative to the end portion in the +Y direction. The lower wall portion 32A supports the sheet P being discharged from the pair of discharging rollers 31 and guides the sheet P to the relay unit 60 which is described later.

The upper wall portion 32B faces the lower wall portion 32A. When the leading end of the sheet P being discharged from the discharging rollers 31 is curled up, the upper wall portion 32B restricts the curling-up of the sheet P by being in contact with it.

The gently-bending unit 34 is capable of switching between performing and not performing a gently-bending operation on the sheet P. The gently-bending operation on the sheet P means an operation to deform a sheet P such that the shape of the sheet P viewed from the E direction is in a wavy form.

The wavy form means not only shapes having peaks and valleys alternately in the sheet width direction but also shapes having at least one peak and shapes having at least one valley.

When an external force along the E direction is exerted on a gently-bent sheet P, since the shape of the sheet P has a wavy form, and the rigidity of the sheet P against external forces is higher, the sheet P is more difficult to be bent. Although a plurality of gently-bending units 34 are provided at intervals in the X direction, FIG. 4 shows only one gently-bending unit 34.

The gently-bending unit 34 includes, as an example, a holder 35, a pressing roller 36, and a holder drive unit 37. Note that a not-illustrated frame of the apparatus body 12 has a rotation shaft 38. The rotation shaft 38 extends along the X direction.

The holder 35 is positioned side by side in the X direction with the drive roller 31A. The holder 35 is a member which is long in one direction. The proximal end portion of the holder 35 is coupled to the rotation shaft 38. With this configuration, the distal end portion of the holder 35, which is opposite to the proximal end portion, is rotatable around the rotation shaft 38.

The pressing roller 36 has an axis extending in the X direction and is rotatably supported by the distal end portion of the holder 35. The pressing roller 36 includes a plurality of disk-shaped members arranged at intervals in the X direction. The pressing roller 36 gently bends the sheet P by coming in contact with the sheet P being discharged from the nipping of the pair of discharging rollers 31, from a position in the +Z direction toward a position in the −Z direction.

The holder drive unit 37 includes, as an example, a not-illustrated spring that applies a pressing force including a −Z direction component to the holder 35 and a motor 37A that rotates the holder 35 in the direction to resist the pressing force. Driving of the holder drive unit 37 is controlled by the control unit 50 (FIG. 2). The motor 37A, when turned on, rotates the rotation shaft 38. Note that the motor 37A, when not turned on, releases holding of the rotation shaft 38.

When the lower path member 86 described later is in the first state, the gently-bending unit 34 drives the holder drive unit 37 to make the holder 35 and the pressing roller 36 retreat from the discharge path T3 of the sheet P. In other words, the gently-bending unit 34, when the lower path member 86 is in the first state described later, does not perform the gently-bending operation on the sheet P being discharged.

When the lower path member 86 is in the second state described later, the gently-bending unit 34 turns off the holder drive unit 37 to make the holder 35 and the pressing roller 36 protrude into the discharge path T3 of the sheet P. In other words, the gently-bending unit 34, when the lower path member 86 is in the second state, performs the gently-bending operation on the sheet P. The operation of the gently-bending unit 34 is controlled by the control unit 50.

As illustrated in FIG. 1, the mounting unit 40 is, as an example, provided at a position in the +Z direction relative to the printing unit 20 and the inversion path T5 of the apparatus body 12. The mounting unit 40 is a portion on which at least one sheet P discharged from the discharging unit 30 can be mounted.

The mounting unit 40 includes, as an example, a shaft 42, a first bottom portion 44, a second bottom portion 46, and a release lever 48 (FIG. 3).

The shaft 42 extends in the X direction. Both end portions in the X direction of the shaft 42 are supported by a not-illustrated frame member of the apparatus body 12.

The first bottom portion 44 is formed in a plate shape. The width in the X direction of the first bottom portion 44 is larger than the width in the X direction of the sheet P. The proximal end portion in the +Y direction of the first bottom portion 44 is rotatably coupled to the shaft 42. With this configuration, the distal end portion in the −Y direction of the first bottom portion 44 is rotatable around the shaft 42. The first bottom portion 44 serves as an upper portion of the inversion path T5. As described above, the first bottom portion 44 is capable of opening and closing the inversion path T5 by being rotated.

In the state in which the first bottom portion 44 closes the inversion path T5, the first bottom portion 44 is inclined such that the distal end portion in the −Y direction is positioned in the +Z direction relative to the proximal end portion in the +Y direction. The end surface in the +Z direction of the first bottom portion 44 is defined as an upper surface 44A.

The second bottom portion 46 is positioned in the −Y direction relative to the first bottom portion 44. The second bottom portion 46 is fixed to a not-illustrated frame member of the apparatus body 12. The end surface in the +Z direction of the second bottom portion 46 is defined as an upper surface 46A. The upper surface 46A is inclined such that the end portion in the −Y direction is positioned in the +Z direction relative to the end portion in the +Y direction. In the state in which the first bottom portion 44 is closed, the upper surface 46A serves together with the upper surface 44A as the mounting surface 43. Sheets P are mounted on the mounting surface 43.

The release lever 48 (FIG. 3) is provided at an end portion in the −X direction of the first bottom portion 44. The release lever 48 has a function of locking the first bottom portion 44 on a not-illustrated frame member. The release lever 48, when being operated, releases locking of the first bottom portion 44.

Figure 5:
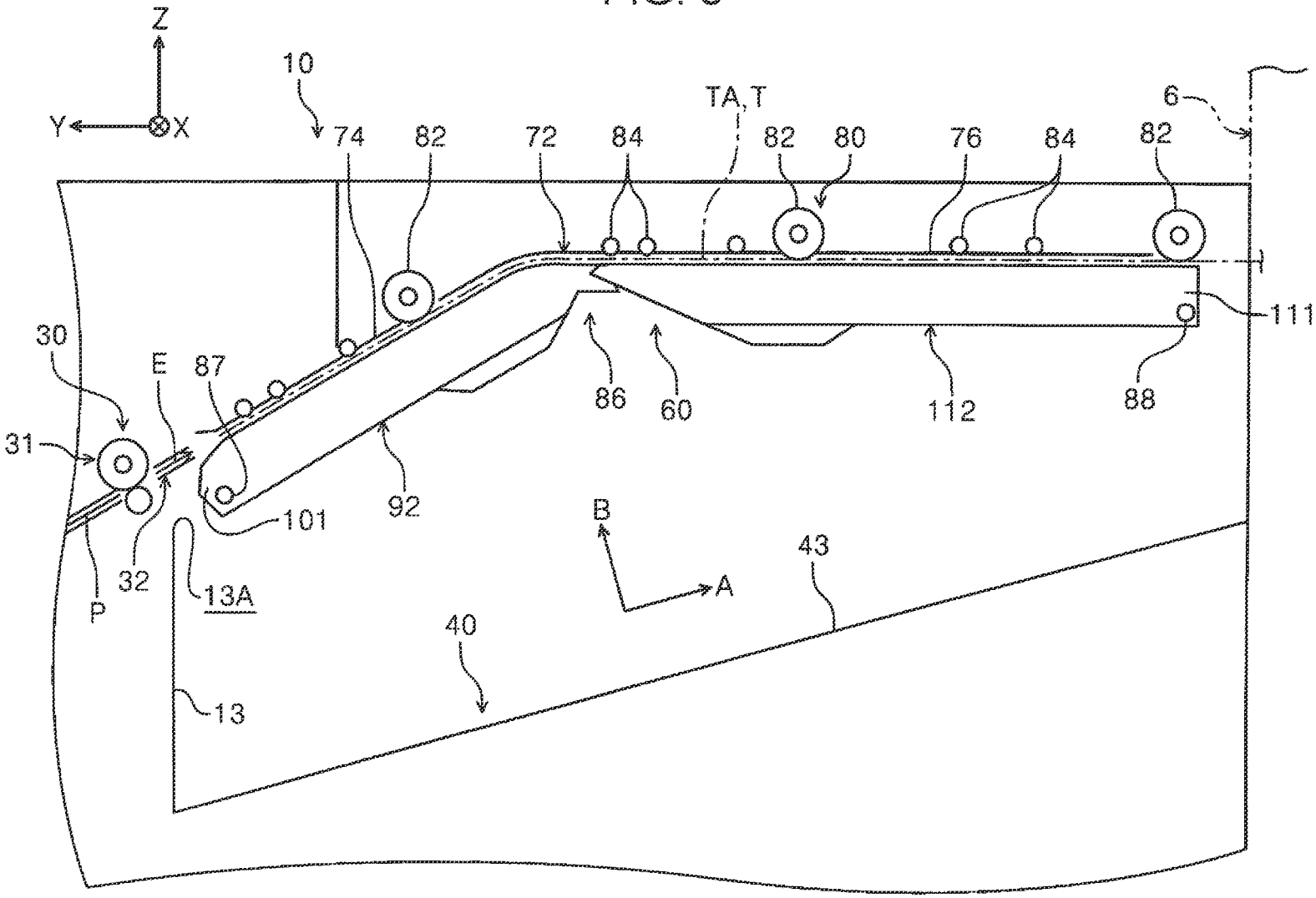
FIG. 5 is a schematic diagram of a lower path member in a first state in the printing system according to Embodiment 1.

As illustrated in FIG. 5, when the mounting unit 40 is viewed from the X direction, the oblique direction in which the mounting surface 43 extends is defined as the A direction. In the A direction, the direction having a component of the +Z direction is defined as the +A direction, and the direction having a component of the −Z direction the −A direction. The direction orthogonal to the A direction is defined as the B direction. In the B direction, the direction having a component of the +Z direction is defined as the +B direction, and the direction having a component of the −Z direction the −B direction.

As illustrated in FIG. 3, the relay unit 60 is provided at a position in the −Y direction and in the +Z direction relative to the center portion of the apparatus body 12. The relay unit 60 is positioned in the +Z direction relative to the mounting unit 40 and faces the mounting unit 40. When the relay unit 60 is viewed from a position in the +Z direction toward the −Z direction, the relay unit 60 covers the mounting unit 40. Note that the apparatus body 12 is provided with a cover member 24.

The cover member 24 covers the end portion in the −X direction and the end portion in the −Y direction of the relay unit 60. The cover member 24 has an outlet 23 at its end portion in the −Y direction. The outlet 23 is an opening through which sheets P are sent out toward the post-process unit 6 (FIG. 1).

Figure 10:
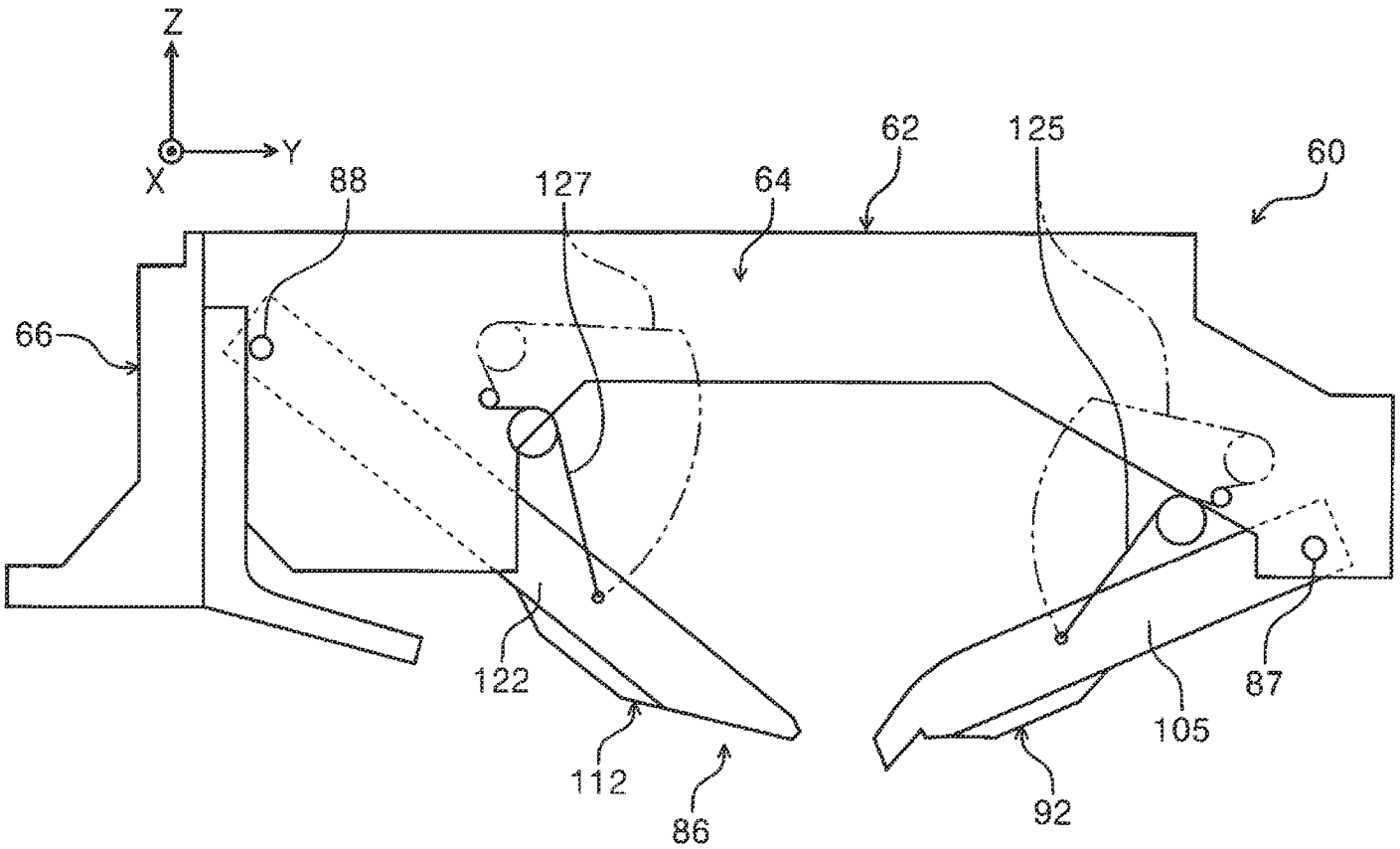
FIG. 10 is a schematic diagram illustrating the relay unit viewed from the rear side in the printing system according to Embodiment 1.

As illustrated in FIG. 5, the relay unit 60 is an example of a relay transportation unit capable of transporting the sheet P discharged from the discharging unit 30 to the post-process unit 6. The relay unit 60 includes, as an example, a body frame 62 (FIG. 6), an upper path member 72, the rotation mechanism unit 80, the lower path member 86, a first rotation shaft 87, a second rotation shaft 88, a spring member 125, and a spring member 127 (FIG. 10). Note that of the transportation path T of the sheet P, a path between the discharging unit 30 and the post-process unit 6 is defined as a relay path TA. In other words, the transportation path T includes the relay path TA.

Figure 6:
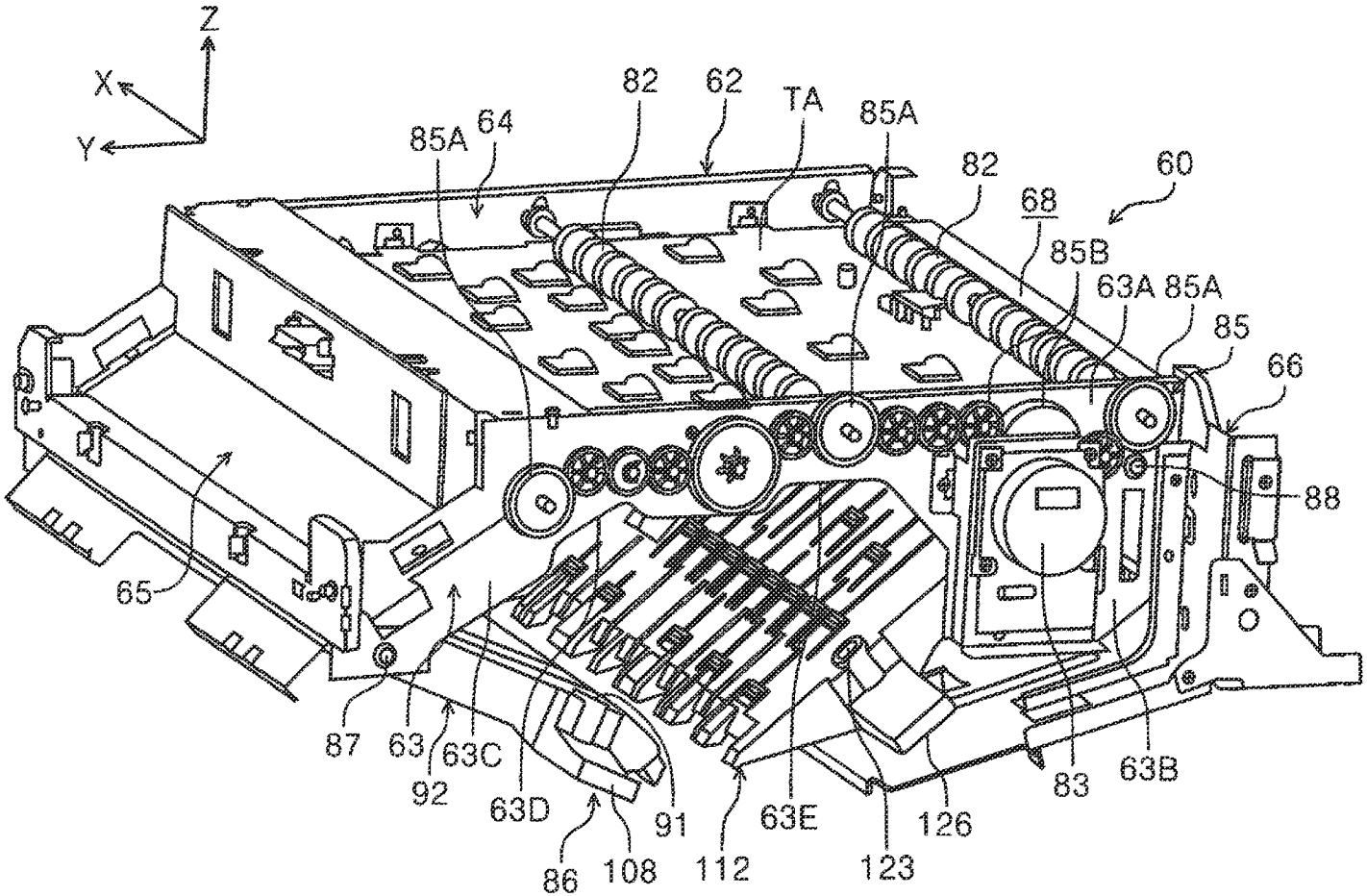
FIG. 6 is a perspective view of a relay unit of the printing system according to Embodiment 1.

As illustrated in FIG. 6, the body frame 62 includes, as an example, a front frame 63, a rear frame 64, a left frame 65, and a right frame 66.

The front frame 63 is a side plate having a specified thickness in the X direction. The front frame 63 is positioned in the −X direction relative to the relay path TA. The front frame 63 includes a horizontal portion 63A extending in the Y direction, a vertical portion 63B extending in the −Z direction from the end portion in the −Y direction of the horizontal portion 63A, and an inclined portion 63C extending in the +Y direction and in the −Z direction from the end portion in the +Y direction of the horizontal portion 63A.

The horizontal portion 63A is provided with a gear portion 85 described later. To the vertical portion 63B is attached a drive motor 83 described later. The vertical portion 63B supports the end portion in the −X direction of the second rotation shaft 88 described later such that the second rotation shaft 88 is rotatable. The inclined portion 63C supports the end portion in the −X direction of the first rotation shaft 87 described later such that the first rotation shaft 87 is rotatable.

The horizontal portion 63A has, at its end portion in the −Z direction, a first cutout portion 63D and a second cutout portion 63E. The first cutout portion 63D can accommodate part of a first operation portion 108 described later. The second cutout portion 63E can accommodate part of a second operation portion 126 described later.

The horizontal portion 63A is provided with not-illustrated contact portions that come in contact with magnets 91 and 123 described later. The magnet 91 coming in contact with the contact portion makes the first lower path member 92 described later held in the first state. The magnet 123 coming in contact with the contact portion makes a second lower path member 112 held in a closed state.

The rear frame 64 is positioned in the +X direction relative to the front frame 63. The rear frame 64 has a size and a shape the same as or similar to those of the front frame 63. The rear frame 64 supports an end portion in the +X direction of the first rotation shaft 87 described later and an end portion in the +X direction of the second rotation shaft 88 such that the first rotation shaft 87 and the second rotation shaft 88 are rotatable.

The left frame 65 extends in the X direction so as to couple an end portion in the +Y direction of the front frame 63 and an end portion in the +Y direction of the rear frame 64. The left frame 65 includes a plurality of plate members and covers part of the relay path TA.

The right frame 66 extends in the X direction so as to couple an end portion in the −Y direction of the front frame 63 and an end portion in the −Y direction of the rear frame 64. The right frame 66 includes a plurality of plate members and is positioned in the −Z direction relative to the relay path TA. The right frame 66 has a discharge opening 68 through which the sheet P is discharged. The discharge opening 68 is included in the outlet 23 (FIG. 3).

As illustrated in FIG. 5, the upper path member 72 serves as an upper portion positioned in the +Z direction relative to the center in the Z direction of the relay path TA. The upper path member 72 is provided with the rotation mechanism unit 80 described later. The upper path member 72 has, as an example, an inclined wall 74 and an upper wall 76.

The inclined wall 74 is positioned downstream in the E direction of the discharging guide 32. The inclined wall 74 is inclined such that the end portion in the −Y direction is positioned in the +Z direction relative to the end portion in the +Y direction. In other words, the inclined wall 74 extends obliquely upward relative to the discharging guide 32.

The upper wall 76 extends in the −Y direction from the end portion in the −Y direction of the inclined wall 74. The upper wall 76 is, as an example, coupled to the inclined wall 74. The part at which the upper wall 76 and the inclined wall 74 are coupled is curved.

The rotation mechanism unit 80, when rotating by being driven, transports the sheet P from the discharging unit 30 toward the post-process unit 6. The rotation mechanism unit 80 includes, as an example, pluralities of upper rollers 82, the drive motor 83 (FIG. 6), pluralities of star-wheel rollers 84, and the gear portion 85 (FIG. 6).

The pluralities of upper rollers 82 are arranged on the upper path member 72 at intervals in the E direction. The plurality of upper rollers 82 are arranged also in the X direction. The pluralities of upper rollers 82 are rotated on rotation shafts extending along the X direction. Parts of the outer peripheral surfaces of the pluralities of upper rollers 82 are exposed into the relay path TA from the upper path member 72 and can come in contact with the sheet P.

The pluralities of star-wheel rollers 84 are provided on the upper path member 72 at intervals in the E direction at positions different from the positions of the pluralities of upper rollers 82. The pluralities of star-wheel rollers 84 are rotated on rotation shafts extending along the X direction. The outer peripheral portion of each of the pluralities of star-wheel rollers 84 has a not-illustrated plurality of tooth portions. The outer diameter of the star-wheel roller 84 is smaller than that of the upper roller 82. The pluralities of star-wheel rollers 84 are rotated by being driven by the contact with the sheet P being transported.

As illustrated in FIG. 6, the drive motor 83 operates by being controlled by the control unit 50 (FIG. 2) to rotate or stop the pluralities of upper rollers 82.

The gear portion 85 includes a plurality of drive gears 85A and a plurality of idler gears 85B. The drive gears 85A are attached to an end portion in the −X direction of the upper rollers 82. The idler gears 85B transmit the driving force from the drive motor 83 to the drive gears 85A.

As illustrated in FIG. 5, the lower path member 86 serves as a lower portion positioned in the −Z direction relative to the center in the Z direction of the relay path TA. The lower path member 86 is an example of a switching member. The lower path member 86 is capable of switching between the first state in which the lower path member 86 serves as part of the relay path TA of the sheet P from the discharging unit 30 to the post-process unit 6 and the second state in which the lower path member 86 opens the relay path TA to the mounting unit 40. The lower path member 86, as an example, does not have a drive motor 83 and a gear portion 85 as the rotation mechanism unit 80.

The lower path member 86 includes, as an example, the first lower path member 92 and the second lower path member 112. The width in the X direction of each of the first lower path member 92 and the second lower path member 112 is larger than the width in the X direction width of the sheet P.

The first lower path member 92 can rotate around the first rotation shaft 87 described later.

The second lower path member 112 can rotate around the second rotation shaft 88 described later.

Here, of the lower path member 86, the first lower path member 92 is switched between the first state and the second state by being rotated around the first rotation shaft 87. Note that in the present embodiment, as an example, the first state and the second state are not defined regarding the rotation of the second lower path member 112.

Figure 7:
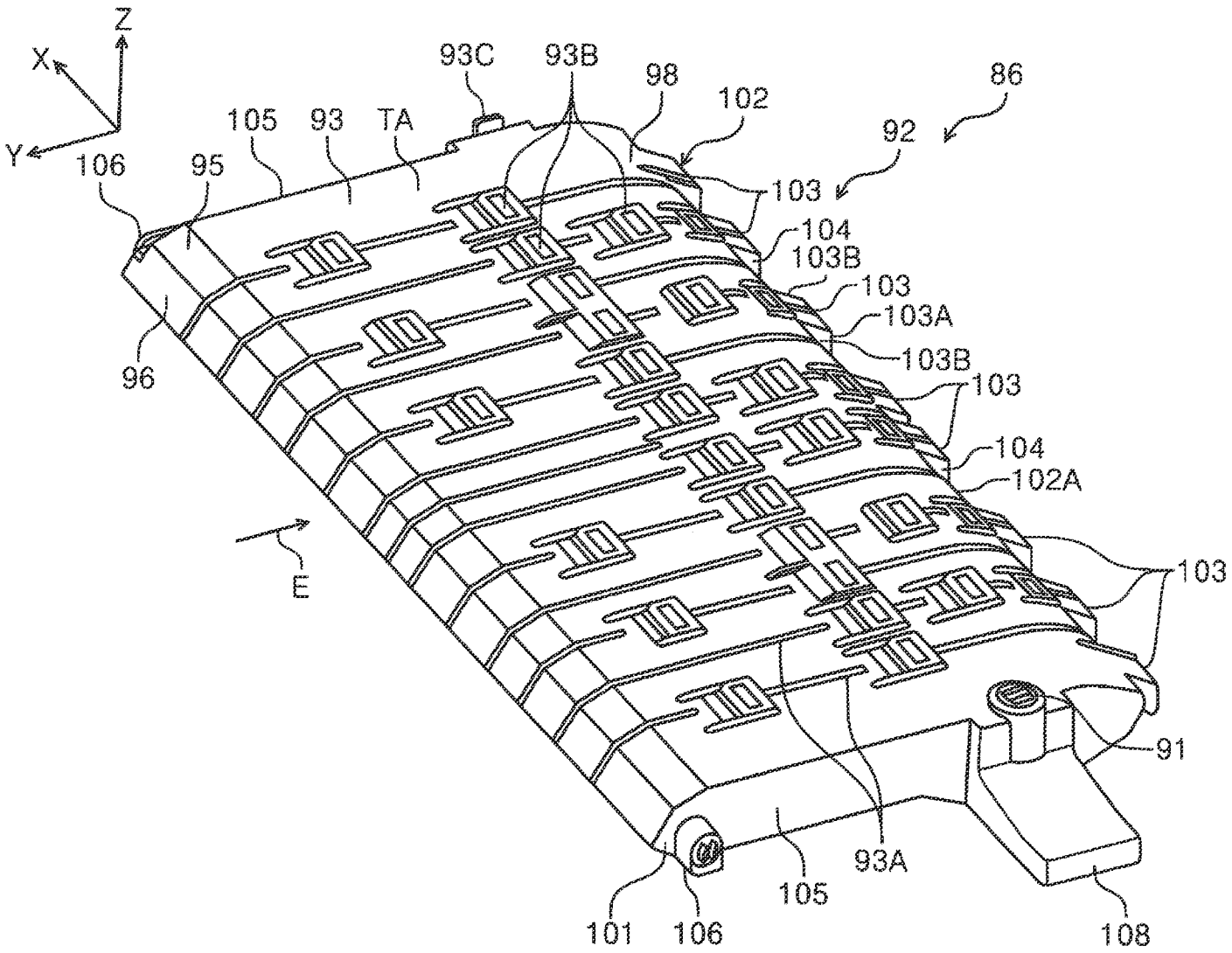
FIG. 7 is a perspective view of a first lower path member of the printing system according to Embodiment 1.

FIG. 7 illustrates the first lower path member 92 placed along the X-Y plane.

The first lower path member 92, when viewed from the Z direction, has a rectangular shape in which the dimension in the X direction is longer than the dimension in the Y direction. The first lower path member 92 has a specified height in the Z direction. Specifically, the first lower path member 92 has an upper wall 93, a first inclined wall 95, a second inclined wall 96, a curved wall 98, a distal end portion 102, two side walls 105, projections 106, and the first operation portion 108. Note that the end portion in the +Y direction of the first lower path member 92 is defined as a proximal end portion 101.

The upper wall 93 is formed to be a plate shape having a specified thickness in the Z direction. The upper wall 93 has a plurality of ribs 93A protruding in the +Z direction from the upper wall 93. The upper wall 93 also has a plurality of roller holding portions 93B that hold not-illustrated rollers such that those rollers are rotatable. The upper wall 93 has, at its end portion in the +X direction, a butting portion 93C standing upright in the +Z direction from the upper wall 93.

When the lower path member 86 is in the first state described later, the butting portion 93C is in contact with part of the body frame 62 (FIG. 6) to make a space for the relay path TA between the upper wall 93 and the body frame 62. In addition, the magnet 91 is attached to a portion that is at the end portion in the −X direction of the upper wall 93 and that is positioned in the −Y direction relative to the center in the Y direction of the upper wall 93.

The first inclined wall 95 extends from the end portion in the +Y direction of the upper wall 93 obliquely downward in the +Y direction and in the −Z direction.

The second inclined wall 96 extends from the end portion in the +Y direction of the first inclined wall 95 obliquely downward in the +Y direction and in the −Z direction. The angle formed between the second inclined wall 96 and the Y direction is larger than the angle formed between the first inclined wall 95 and the Y direction.

The curved wall 98 extends from the end portion in the −Y direction of the upper wall 93 in a curved shape in the −Y direction and in the −Z direction.

The distal end portion 102 has a vertical wall 102A, a plurality of protrusions 103, and a plurality of recesses 104. In other words, the plurality of protrusions 103 and the plurality of recesses 104 are provided at the downstream end in the E direction of the first lower path member 92.

The vertical wall 102A extends in the −Z direction from the end portion in the −Y direction of the curved wall 98.

The plurality of protrusions 103 protrude from the vertical wall 102A obliquely downward in the −Y direction and in the −Z direction. The plurality of protrusions 103 are lined in the X direction at intervals. The protrusion 103 has a size that can be inserted in the Z direction into the recess 121 (FIG. 8) described later.

The protrusion 103 has a parallelogram outer shape, viewed from the X direction. At the end portion in the −Y direction of the protrusion 103 is provided a side wall 103A. At both end portions in the X direction of the protrusion 103 are provided side walls 103B.

The plurality of recesses 104 are lined in the X direction at intervals. The recess 104 has the vertical wall 102A and the two side walls 103B. The recess 104 accommodates insertion in the Z direction of a protrusion 119 (FIG. 8) described later.

The two side walls 105 extend in the −Z direction from both end portions in the X direction of the upper wall 93, the first inclined wall 95, and the second inclined wall 96.

The projections 106 are provided at the proximal end portion 101. The projections 106 protrude from the side walls 105 outward in the X direction. The projections 106 support the first rotation shaft 87 (FIG. 5).

The first operation portion 108 extends in the −X direction from the side wall 105 in the −X direction at a peripheral portion of the part at which the magnet 91 is provided. The first operation portion 108 is held and rotated by a not-illustrated operator. The distance from the first operation portion 108 to the distal end portion 102 is shorter than the distance from the first operation portion 108 to the projection 106.

Figure 9:
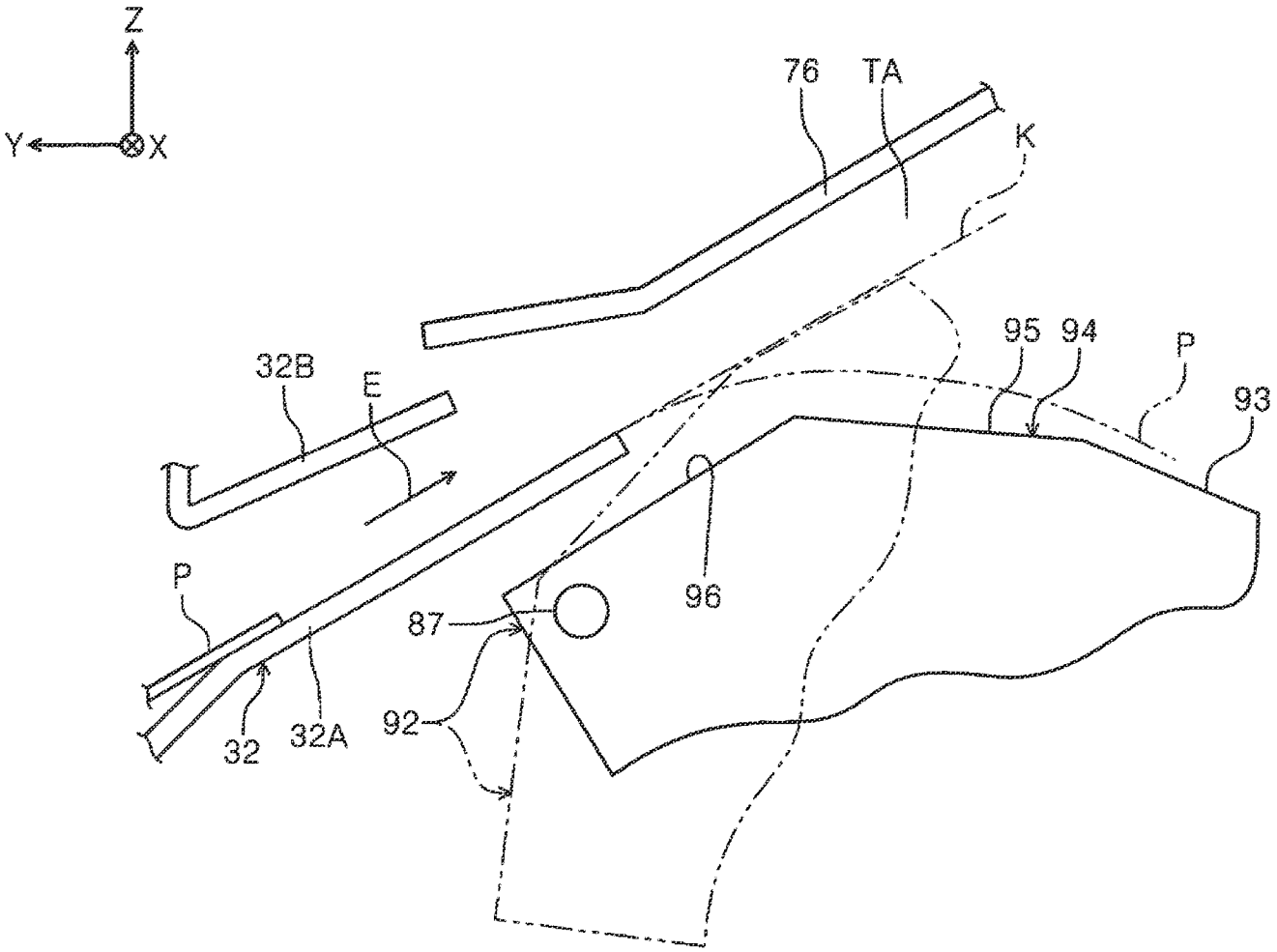
FIG. 9 is an enlarged schematic diagram of a transportation path and part of the first lower path member being rotated in the printing system according to Embodiment 1.

As illustrated in FIG. 9, as an example, the first inclined wall 95 and the second inclined wall 96 form a supporting portion 94. In other words, the supporting portion 94 that supports the sheet P is provided at the end portion upstream in the E direction of the first lower path member 92. The supporting portion 94, when the first lower path member 92 is in the second state, protrudes in the +Z direction. Here, the straight line that extends in the +E direction from the distal end portion in the E direction of the lower wall portion 32A is defined as an imaginary line K. The imaginary line K is depicted with the dashed dotted line K.

The first lower path member 92 is positioned lower than the imaginary line K in the orthogonal direction that is orthogonal to the E direction.

In FIG. 9, the first lower path member 92 in the first state is indicated by dashed double-dotted lines, and the first lower path member 92 in the second state by solid lines.

Figure 8:
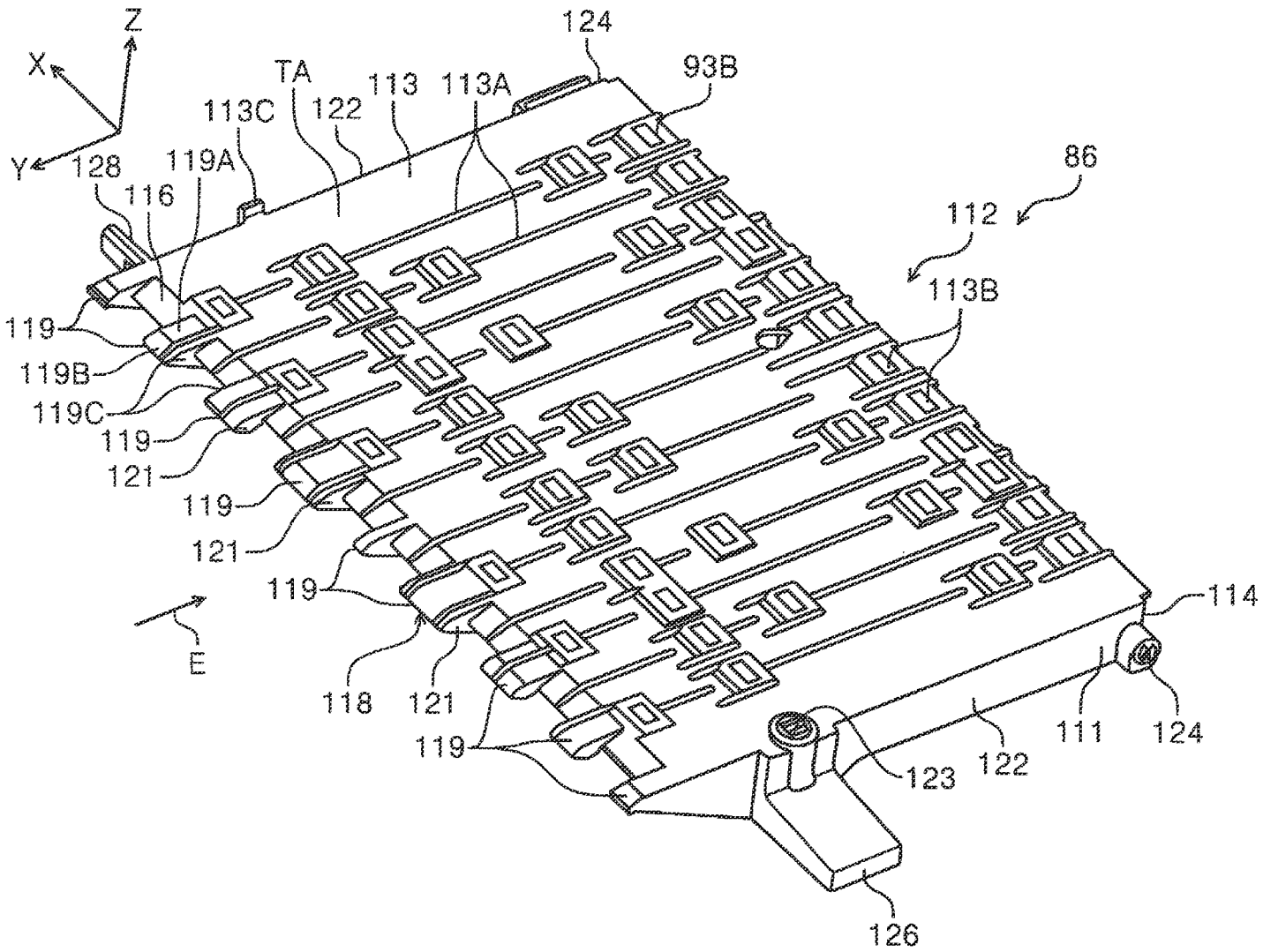
FIG. 8 is a perspective view of a second lower path member of the printing system according to Embodiment 1.

FIG. 8 illustrates the second lower path member 112 placed along the X-Y plane.

The second lower path member 112, when viewed from the Z direction, has a rectangular shape in which the dimension in the X direction is longer than the dimension in the Y direction. The second lower path member 112 has a specified height in the Z direction. Specifically, the second lower path member 112 has an upper wall 113, a vertical wall 114, an inclined wall 116, a distal end portion 118, two side walls 122, projections 124, the second operation portion 126, and a detection portion 128. Note that the end portion in the −Y direction of the second lower path member 112 is defined as a proximal end portion 111.

The upper wall 113 is formed to be a plate shape having a specified thickness in the Z direction. The upper wall 113 has a plurality of ribs 113A protruding in the +Z direction from the upper wall 113. The upper wall 113 also has a plurality of roller holding portions 113B that hold a plurality of not-illustrated rollers such that the rollers are rotatable. The upper wall 113 has, at its end portion in the +X direction, a butting portion 113C standing upright in the +Z direction from the upper wall 113.

The butting portion 113C comes in contact with part of the body frame 62 (FIG. 6) to make a space for the relay path TA between the upper wall 113 and the body frame 62. In addition, the magnet 123 is attached to a portion that is at the end portion in the −X direction of the upper wall 113 and that is positioned in the +Y direction relative to the center in the Y direction of the upper wall 113.

The vertical wall 114 extends in the −Z direction from the end portion in the −Y direction of the upper wall 113.

The inclined wall 116 extends from the end portion in the +Y direction of the upper wall 113 obliquely downward in the +Y direction and in the −Z direction.

The distal end portion 118 has the inclined wall 116, a plurality of protrusions 119, and a plurality of recesses 121. In other words, the plurality of protrusions 119 and the plurality of recesses 121 are provided at the upstream end in the E direction of the second lower path member 112.

The plurality of protrusions 119 protrude in the +Y direction from the inclined wall 116. The plurality of protrusions 119 are lined in the X direction at intervals. The protrusion 119 has a size that can be inserted in the Z direction into the recess 104 (FIG. 7).

The protrusion 119 has an upper surface 119A positioned at the end portion in the +Z direction and an inclined surface 119B extending obliquely downward from the end portion in the +Y direction of the upper surface 119A. At both end portions in the X direction of the protrusion 119 are provided side walls 119C.

The plurality of recesses 121 are lined in the X direction at intervals. The recess 121 is a portion formed by the two side walls 119C and the inclined wall 116. The recess 121 accommodates insertion in the Z direction of the protrusion 103 (FIG. 7).

The two side walls 122 extend in the −Z direction from both ends portions in the X direction of the upper wall 113, the vertical wall 114, and the inclined wall 116.

The projections 124 are provided at the proximal end portion 111. The projections 124 protrude from the side walls 122 outward in the X direction. The projections 124 support the second rotation shaft 88 (FIG. 5).

The second operation portion 126 extends in the −X direction from the side wall 122 in the −X direction at a peripheral portion of the part at which the magnet 123 is provided. The second operation portion 126 is held and operated by a not-illustrated operator. The distance from the second operation portion 126 to the distal end portion 118 is shorter than the distance from the second operation portion 126 to the projection 124.

The detection portion 128 is a portion extending in the +X direction from an end portion in the +Y direction of the side wall 122 in the +X direction. The detection portion 128 is, as an example, formed to be a prism shape. When the second lower path member 112 is placed along the X-Y plane, in other words, when the lower path member 86 is in the first state, the detection portion 128 interrupts light from the opening/closing sensor 56 (FIG. 2). When the second lower path member 112 is in the state in which it opens the relay path TA, the detection portion 128 does not interrupt the light from the opening/closing sensor 56.

As illustrated in FIG. 5, the first rotation shaft 87 is positioned in the −Y direction and in the −Z direction relative to the center in the E direction of the discharging guide 32. The first rotation shaft 87 is rotatably supported by a not-illustrated frame member of the apparatus body 12. The first rotation shaft 87 extends in the X direction which intersects both the E direction and the Z direction. The first rotation shaft 87 is a columnar member. The first rotation shaft 87 supports the first lower path member 92 such that the first lower path member 92 is rotatable.

Specifically, the proximal end portion 101 of the first lower path member 92 is attached to the first rotation shaft 87. The first lower path member 92 is switched between the first state and the second state by being rotated around the first rotation shaft 87.

The second lower path member 112 is positioned downstream in the E direction of the first lower path member 92.

The second rotation shaft 88 is positioned in the −Z direction relative to the upper wall 76. The second rotation shaft 88 is rotatably supported by a not-illustrated frame member of the apparatus body 12. The second rotation shaft 88 is a columnar member extending in the X direction. The second rotation shaft 88 supports the second lower path member 112 such that the second lower path member 112 is rotatable.

Specifically, the proximal end portion 111 in the −Y direction of the second lower path member 112 is attached to the second rotation shaft 88. In other words, the end portion downstream in the E direction of the second lower path member 112 is rotatably supported by the second rotation shaft 88. The second lower path member 112 is switched, by being rotated around the second rotation shaft 88, between a closed state in which the second lower path member 112 serves as part of the relay path TA and an open state in which the second lower path member 112 opens the relay path TA.

When the lower path member 86 is in the first state, the first lower path member 92 faces the inclined wall 74 and serves as an upstream portion of the relay path TA. Note that the state in which the first lower path member 92 is positioned to face the inclined wall 74 is defined as the first state of the first lower path member 92.

When the lower path member 86 is in the first state, the second lower path member 112 faces the upper wall 76 and serves as a downstream portion of the relay path TA.

FIG. 10 illustrates the relay unit 60 viewed in the −X direction.

The spring member 125 is, as an example, a torsion coil spring. The spring member 125 has one end attached to the rear frame 64. The other end of the spring member 125 is attached to the side wall 105 in the +X direction of the first lower path member 92.

The spring member 125 functions as a two-stable-state spring. Specifically, when the first lower path member 92 is switched from the first state to the second state, the spring member 125 presses the first lower path member 92 in the −Z direction. When the first lower path member 92 is switched from the second state to the first state, the spring member 125 presses the first lower path member 92 in the +Z direction.

The spring member 127 is, as an example, a torsion coil spring. The spring member 127 has one end attached to the rear frame 64. The other end of the spring member 127 is attached to the side wall 122 in the +X direction of the second lower path member 112.

The spring member 127 functions as a two-stable-state spring. Specifically, when the second lower path member 112 is switched from the closed state in which the second lower path member 112 serves as part of the relay path TA (FIG. 5) to the open state in which the second lower path member 112 opens the relay path TA, the spring member 127 presses the second lower path member 112 in the −Z direction. When the second lower path member 112 is switched from the open state to the closed state, the spring member 127 presses the second lower path member 112 in the +Z direction.

Figure 11:
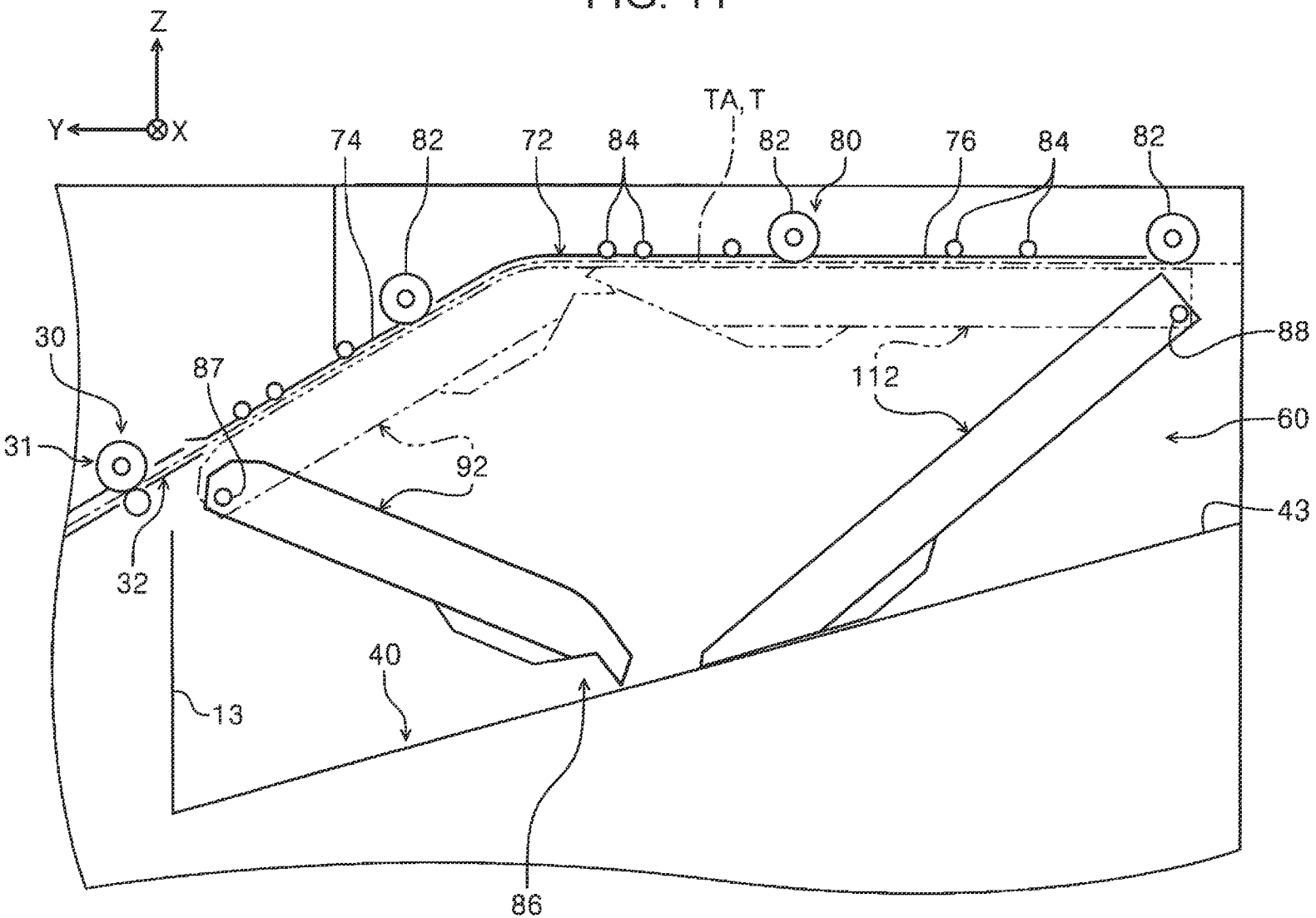
FIG. 11 is a schematic diagram illustrating the lower path member in a second state in the printing system according to Embodiment 1.

As illustrated in FIG. 11, when the lower path member 86 is in the second state, the first lower path member 92 is away in the −Z direction from the inclined wall 74, and the first lower path member 92 opens an upstream portion of the relay path TA to the mounting unit 40. The state in which the first lower path member 92 is positioned to open the upstream portion of the relay path TA is the second state of the first lower path member 92.

When the lower path member 86 is in the second state, the second lower path member 112 is, as an example, away in the −Z direction from the upper wall 76, and opens a downstream portion of the relay path TA to the mounting unit 40. Note that the state in which the second lower path member 112 is positioned to open the downstream portion of the relay path TA is the open state of the second lower path member 112.

Figure 12:
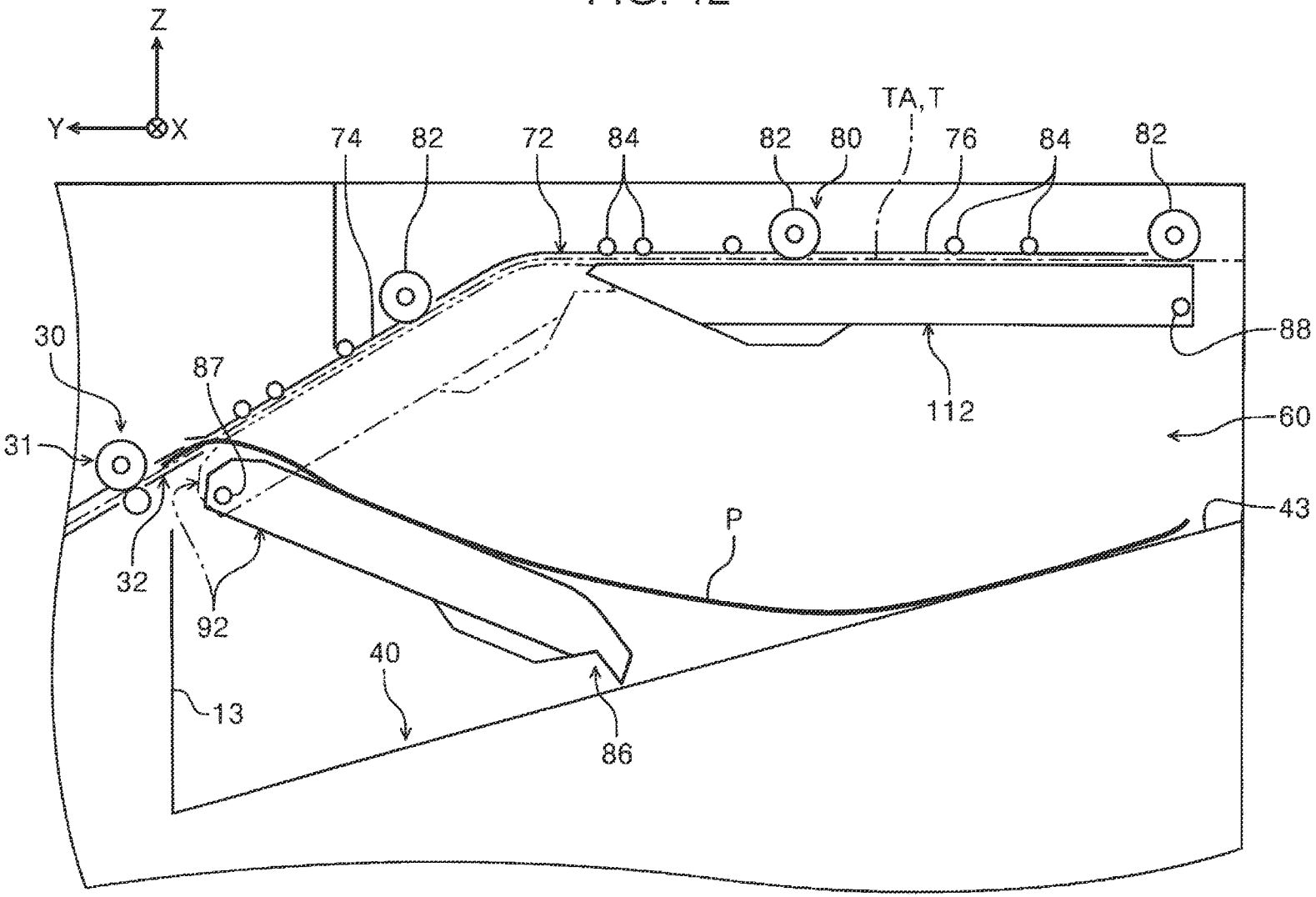
FIG. 12 is a schematic diagram of the first lower path member in the second state and the second lower path member in a closed state in the printing system according to Embodiment 1.

As illustrated in FIG. 12, the case in which the first lower path member 92 is in the second state, and the second lower path member 112 is in the closed state is included in the second state of the lower path member 86. In this case, the sheet P discharged from the discharging unit 30 is transported along the first lower path member 92 to the mounting unit 40.

Figure 13:
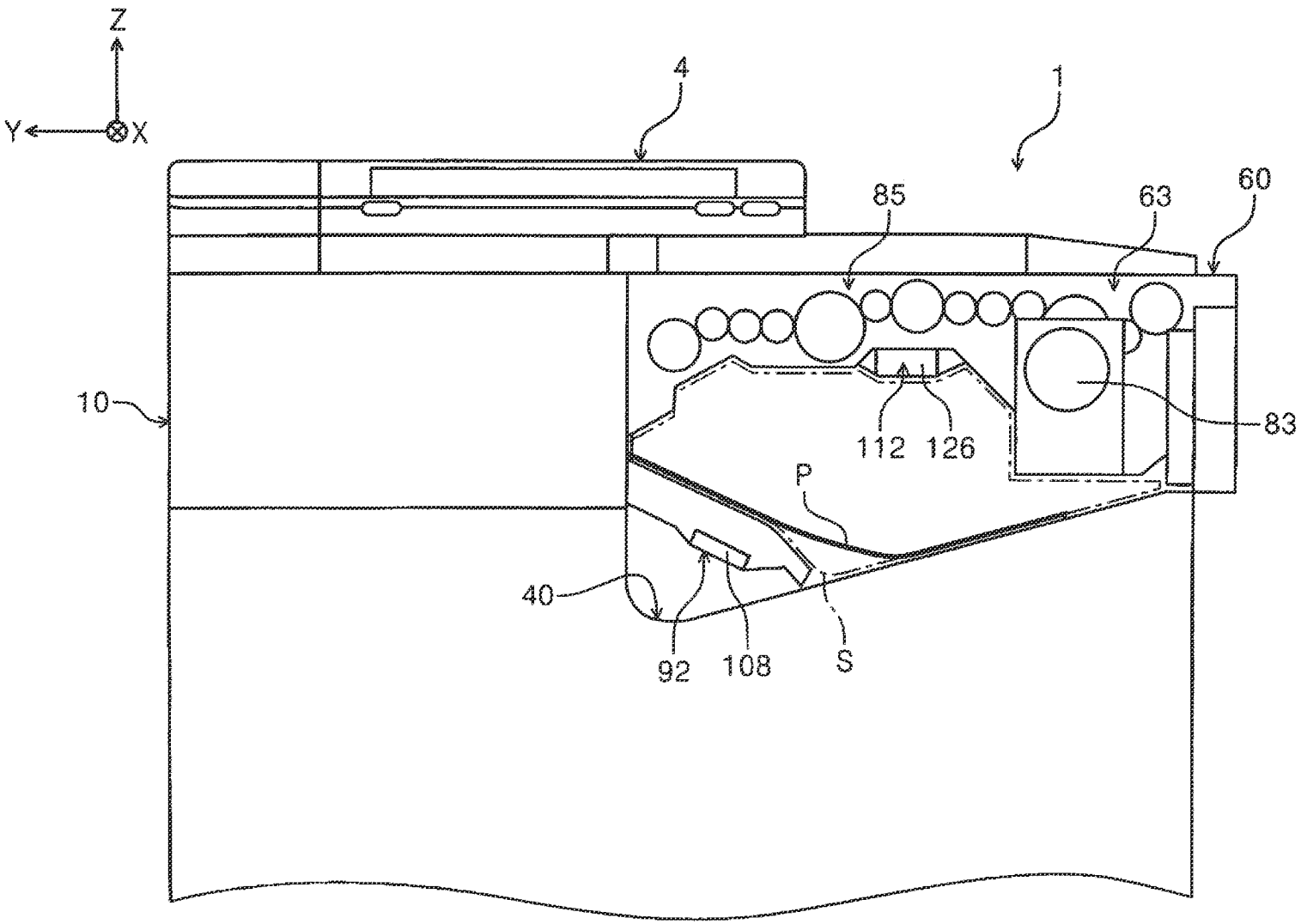
FIG. 13 is a front view of the relay unit with the cover member removed in the printing system according to Embodiment 1.

As illustrated in FIG. 13, when the first lower path member 92 is in the second state, and the second lower path member 112 is in the closed state, the sheet P discharged on the mounting unit 40 can be taken out only from the inside of the opening area S indicated by dashed dotted line S, viewed in the +X direction.

The opening area S is an area surrounded by the front frame 63, the mounting unit 40, the first lower path member 92, and the second lower path member 112, when viewed in the +X direction.

Figure 14:
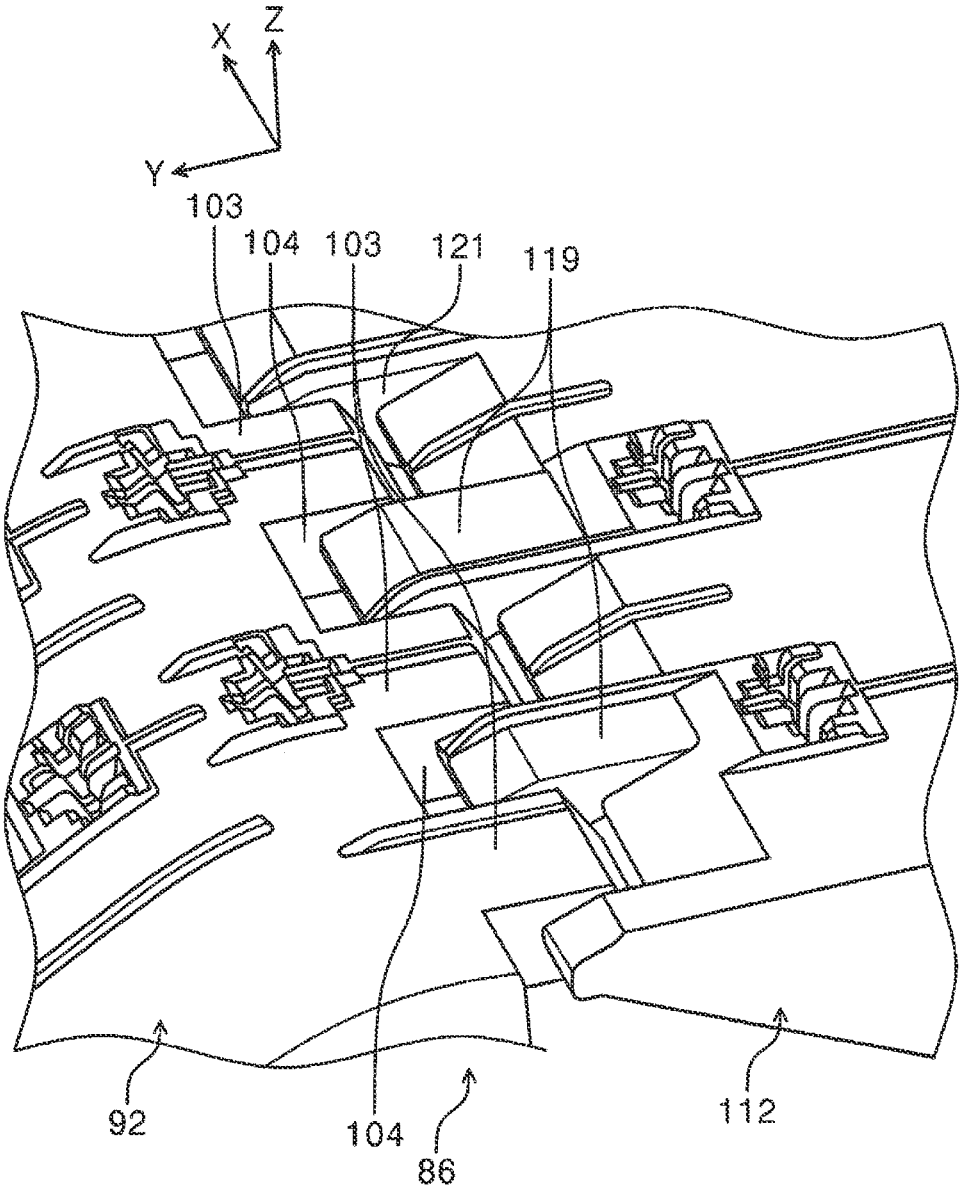
FIG. 14 is a perspective view of protrusions inserted in recesses in the printing system according to Embodiment 1.

As illustrated in FIG. 14, the recesses 104 and the recesses 121 are open in the +Z direction and in the −Z direction. Thus, the protrusions 103 and the recesses 121 can move relative to one another in the Z direction. The protrusions 119 and the recesses 104 can move relative to one another in the Z direction.

When the lower path member 86 is in the first state, specifically, when the first lower path member 92 is in the first state, and the second lower path member 112 is in the closed state, parts of the protrusions 103 are inserted in the recesses 121. Parts of the protrusions 119 are inserted in the recesses 104.

When the lower path member 86 is in the first state, the protrusions 103 and the recesses 121 are not in contact with one another with gaps in between in the X direction and the Z direction. The protrusions 119 and the recesses 104 are not in contact with one another with gaps in between in the X direction and in the Z direction.

With this configuration, when the sheet P is passed over from the first lower path member 92 to the second lower path member 112, any part in the X direction of the sheet P is supported by at least one of the first lower path member 92 and the second lower path member 112.

As illustrated in FIGS. 2 and 8, the opening/closing sensor 56 detects the detection portion 128 of the second lower path member 112. Specifically, the opening/closing sensor 56 is an example of a detection unit that detects the open state and the closed state of the second lower path member 112. In other words, the opening/closing sensor 56 detects the open state and the closed state of the second lower path member 112.

The opening/closing sensor 56 is provided to be positioned in the −Y direction relative to the detection portion 128 of the second lower path member 112 in the closed state. The opening/closing sensor 56 is, as an example, an optical sensor including a not-illustrated light emitting portion and light receiving portion. The information on whether the opening/closing sensor 56 detected light or not is transmitted to the control unit 50.

When light emitted from the light emitting portion is received by the light receiving portion, the opening/closing sensor 56 determines that it is the state in which the detection portion 128 is not detected, in other words, the state in which the second lower path member 112 is in the open state, and transmits non-detection information to the control unit 50. When light emitted from the light emitting portion is not received by the light receiving portion, the opening/closing sensor 56 determines that it is the state in which the detection portion 128 is detected, in other words, the state in which the second lower path member 112 is in the closed state, and transmits detection information to the control unit 50. As described above, the opening/closing sensor 56 directly detects the open state and the closed state of the second lower path member 112.

The interlock circuit 58 illustrated in FIG. 2, when the lower path member 86 (FIG. 5) is in the first state, allows the power to be turned on. When the lower path member 86 is in the second state, the interlock circuit 58 does not allow the power to be turned on. Here, by detecting whether the interlock circuit 58 allows the power to be turned on, it is possible to detect whether the lower path member 86 is in the first state or in the second state. As for the circuit using the interlock circuit 58, a known interlock circuit can be used for it. Note that only detecting whether the interlock circuit 58 allows the power to be turned on cannot make distinguished the open/closed state of the first lower path member 92 and the open/closed state of the second lower path member 112.

In the present embodiment, as an example, based on the detection result of the opening/closing sensor 56 and the detection result of the interlock circuit 58, the control unit 50 determines whether the first lower path member 92 is in the first state or the second state.

Specifically, when the opening/closing sensor 56 detects that the second lower path member 112 is in the closed state and when the interlock circuit 58 does not allow the power to be turned on, the control unit 50 determines that the first lower path member 92 is in the second state. When the interlock circuit 58 allows the power to be turned on, the control unit 50 determines that the first lower path member 92 is in the first state.

When the sheet P transportation operation is being performed, and when the opening/closing sensor 56 detects the open state of the second lower path member 112, the control unit 50 makes the discharging unit 30 stop the operation of discharging sheets P.

Next, effects of the printing system 1 of Embodiment 1 will be described. Since each configuration of the printing system 1 is shown in FIGS. 1 to 14, figure numbers are omitted in the following description.

In the printing system 1, when the post-process unit 6 is operable, the lower path member 86 is set in the first state. After the sheet P printed by the printing unit 20 is discharged by the discharging unit 30 in the E direction, the sheet P is transported to the post-process unit 6 by the relay unit 60, and post-processed by the post-process unit 6.

When the post-process unit 6 turns inoperable, the lower path member 86 is set in the second state, and the relay path TA is opened to the mounting unit 40. Note that it is assumed, as an example, that the second lower path member 112 is in the closed state.

After the sheet P printed by the printing unit 20 is discharged in the E direction from the discharging unit 30, the sheet P falls onto the mounting unit 40 through the open portion of the relay path TA and is mounted on the mounting unit 40.

As described above, when the post-process unit 6 turns inoperable, sheets P are mounted on the mounting unit 40. Thus, the operation of the printing system 1 does not need to be stopped, and this prevents a decrease in the productivity of the printing system 1. In addition, since the sheets P are discharged by using the mounting unit 40 provided to the apparatus body 12, it is possible to prevent an increase in the size of the printing system 1, compared to the configuration in which sheets P are discharged to an apparatus independent of the apparatus body 12.

In the printing system 1, since the lower path member 86 does not have the rotation mechanism unit 80, when the state of the lower path member 86 is switched to the first state or the second state, it is easy to switch the state of the lower path member 86, compared to the configuration in which the lower path member 86 has a rotation mechanism unit 80.

In the printing system 1, since the lower path member 86 is rotated around the first rotation shaft 87, the movable range of the lower path member 86 is smaller than in the configuration in which the lower path member 86 is slid, and thus, less space is necessary for switching between the first state and the second state.

In the printing system 1, since the lower path member 86 is divided into the first lower path member 92 and the second lower path member 112, and the first lower path member 92 is rotatable, when a sheet P transportation error occurs in the path at the lower path member 86, it is easy to take out the sheet P at the lower path member 86.

In the printing system 1, when a sheet P remains in the relay unit 60 due to a transportation error, the first lower path member 92 and the second lower path member 112 can be rotated, making a state like a double-door open state. In this case, the opened range of the relay path TA is wide, and thus it is easy to take the sheet P out of the relay unit 60.

In the printing system 1, when the second lower path member 112 is in the open state, the sheet P is not discharged from the discharging unit 30 toward the relay unit 60, and thus it is possible to prevent the sheet P from falling from the relay path TA on the way toward the post-process unit 6.

In the printing system 1, in the first state in which at least parts of the protrusions 103 and 119 are inserted in the recesses 104 and 121, the sheet P being transported by the relay unit 60 is supported at any position in the E direction by at least one of the first lower path member 92 and the second lower path member 112. This configuration prevents sheet P transportation errors in the relay unit 60, compared to the configuration in which the first lower path member 92 and the second lower path member 112 do not overlap in the E direction, when viewed from the X direction.

Further, since the recesses 104 and 121 and the protrusions 103 and 119 can move relative to one another in the Z direction, no matter which of the first lower path member 92 and the second lower path member 112 is made to retreat first from the relay path TA, it is possible to prevent interference between the first lower path member 92 and the second lower path member 112.

In the printing system 1, when the lower path member 86 is in the first state, the sheet P entering the path at the lower path member 86 is not gently bent, it is easy for the relay unit 60 to transport the sheet P.

In contrast, when the lower path member 86 is in the second state, the gently-bending unit 34 performs the gently-bending operation on the sheet P entering the lower path member 86, and this increase the rigidity against a force acting on the sheet P in the E direction. This makes it less likely for the sheet P to be curled, making it possible to prevent a decrease in the stacking property of the sheets P that would be caused by the sheet P curling in the mounting unit 40.

In the printing system 1, when the sheet P is discharged from the discharging unit 30, the lower path member 86 is not positioned higher than the distal end of the discharging guide 32 in the Z direction orthogonal to the E direction, and thus it is possible to prevent sheet P transportation errors that would be caused by the leading end of the sheet P being caught by the lower path member 86.

In the printing system 1, when the lower path member 86 is in the first state, the sheet P is discharged to the relay unit 60 at the first speed V1.

When the lower path member 86 is in the second state, there is a possibility that the movement of the sheet P may be restricted by the supporting portion 94.

Here, in the printing system 1, when the lower path member 86 is in the second state, the sheet P is discharged from the discharging unit 30 at the second speed V2 which is higher than the first speed V1, and thus accelerated. The accelerated sheet P goes over the supporting portion 94 and falls onto the mounting unit 40. With this configuration, it is possible to reduce sheet P discharge errors, compared to the configuration in which the discharge speed of the sheet P is not changed.

In the printing system 1, when the determination unit 54 determines that the size in the E direction of the sheet P is a size that cannot be mounted on the mounting unit 40, the sheet P having a size that cannot be mounted will not be discharged onto the mounting unit 40. With this configuration, it is possible to prevent the downstream end in the E direction of the sheet P from going over the mounting unit 40, coming into contact with the post-process unit 6 or the like, and being deformed.

Embodiment 2

Next, a printing system 130 of Embodiment 2 will be described with reference to the attached drawings. Portions common to those of the printing system 1 of Embodiment 1 are denoted by the same symbols, and description thereof is omitted.

Figure 15:
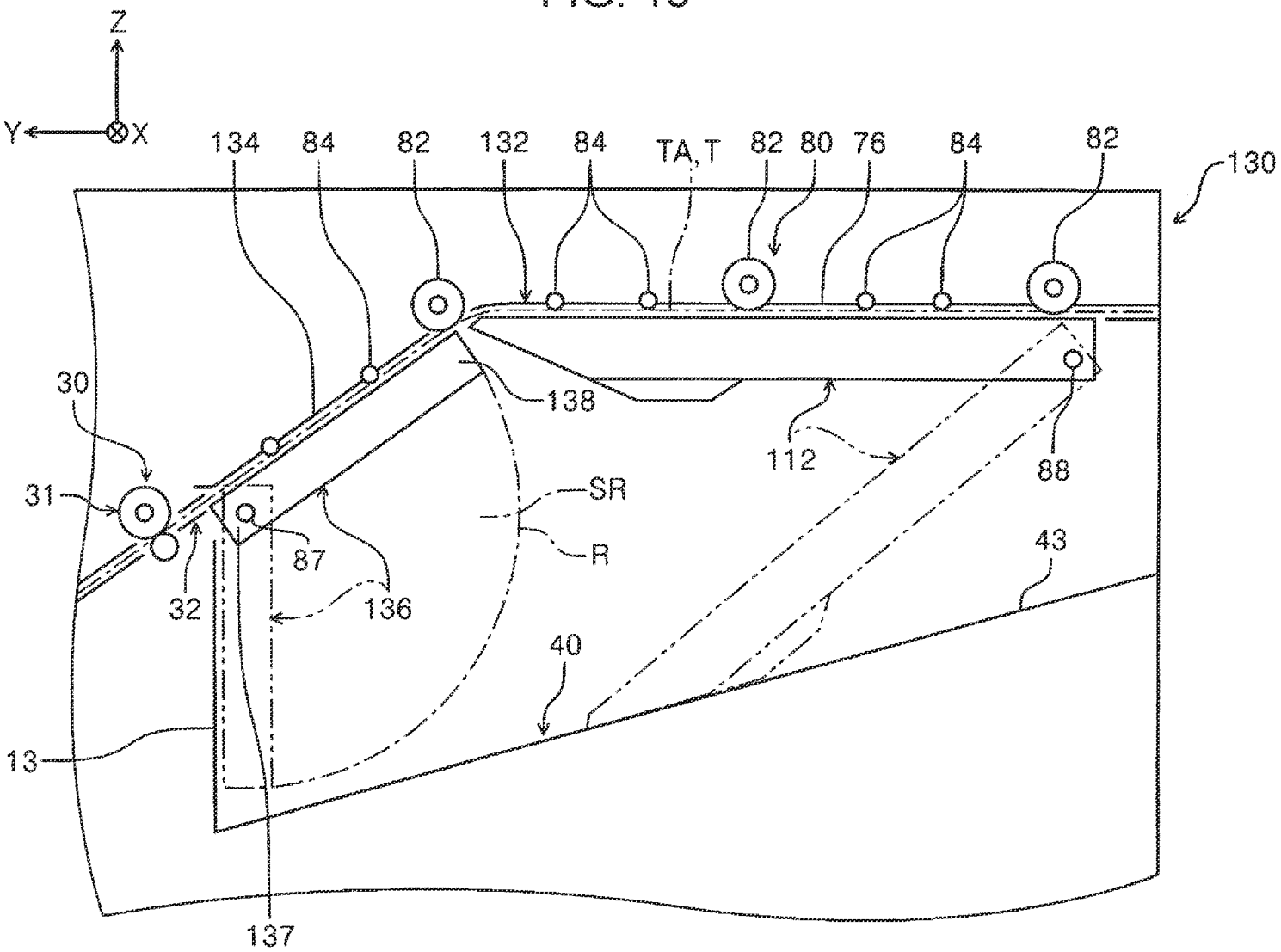
FIG. 15 is a schematic diagram illustrating a first lower path member and a second lower path member in a printing system according to Embodiment 2.

As illustrated in FIG. 15, the printing system 130 of Embodiment 2 has the same configuration as the printing system 1 of Embodiment 1 (FIG. 1) except that the upper path member 72 (FIG. 5) is replaced with an upper path member 132, and the first lower path member 92 (FIG. 5) is replaced with a first lower path member 136, which is an example of a lower path member. The other configurations are the same as or similar to those in Embodiment 1.

The upper path member 132 serves as an upper portion positioned in the +Z direction relative to the center in the Z direction of the relay path TA. The upper path member 132 is provided with the rotation mechanism unit 80. The upper path member 132 has, as an example, an inclined wall 134 and an upper wall 76.

The inclined wall 134 is positioned downstream in the E direction of the discharging guide 32. The inclined wall 134 is inclined such that the end portion in the −Y direction is positioned in the +Z direction relative to the end portion in the +Y direction. In other words, the inclined wall 134 is a wall extending obliquely upward relative to the discharging guide 32.

The first lower path member 136 is formed to be a plate shape having a specified thickness. The first lower path member 136 has a rectangular shape in which the dimension in the X direction is longer than the dimension in the E direction. Note that the upstream end portion in the E direction of the first lower path member 136 is defined as a proximal end portion 137. The downstream end portion in the E direction of the first lower path member 136 is defined as a distal end portion 138. In other words, the distal end portion 138 is positioned opposite to the proximal end portion 137. The proximal end portion 137 is provided to be rotatable around the first rotation shaft 87.

Here, the path of the distal end portion 138 when the first lower path member 136 is rotated around the first rotation shaft 87 is defined as the rotation path R. The area inside the rotation path R is defined as the rotation area SR.

The mounting unit 40 is positioned outside the rotation path R of the distal end portion 138. In other words, when the first lower path member 136 is rotated, the first lower path member 136 does not come in contact with the mounting unit 40.

Next, effects of the printing system 130 of Embodiment 2 will be described.

In the printing system 130, since the mounting unit 40 does not exist within the rotation area SR of the first lower path member 136, the first lower path member 136 can rotate to the position where the first lower path member 136 faces the vertical wall 13. In other words, the first lower path member 136 can be rotated regardless of the arrangement of the mounting unit 40. With this configuration, it is possible to make the space to store sheets P between the first lower path member 136 and the mounting unit 40, and thus it is possible to prevent a decrease in the number of sheets P that can be mounted on the mounting unit 40 when the first lower path member 136 is in the second state.

Embodiment 3

Next, a printing system 140 of Embodiment 3 will be described with reference to the attached drawings. Portions common to those of the printing system 1 or the printing system 130 are denoted by the same symbols, and description thereof is omitted.

Figure 16:
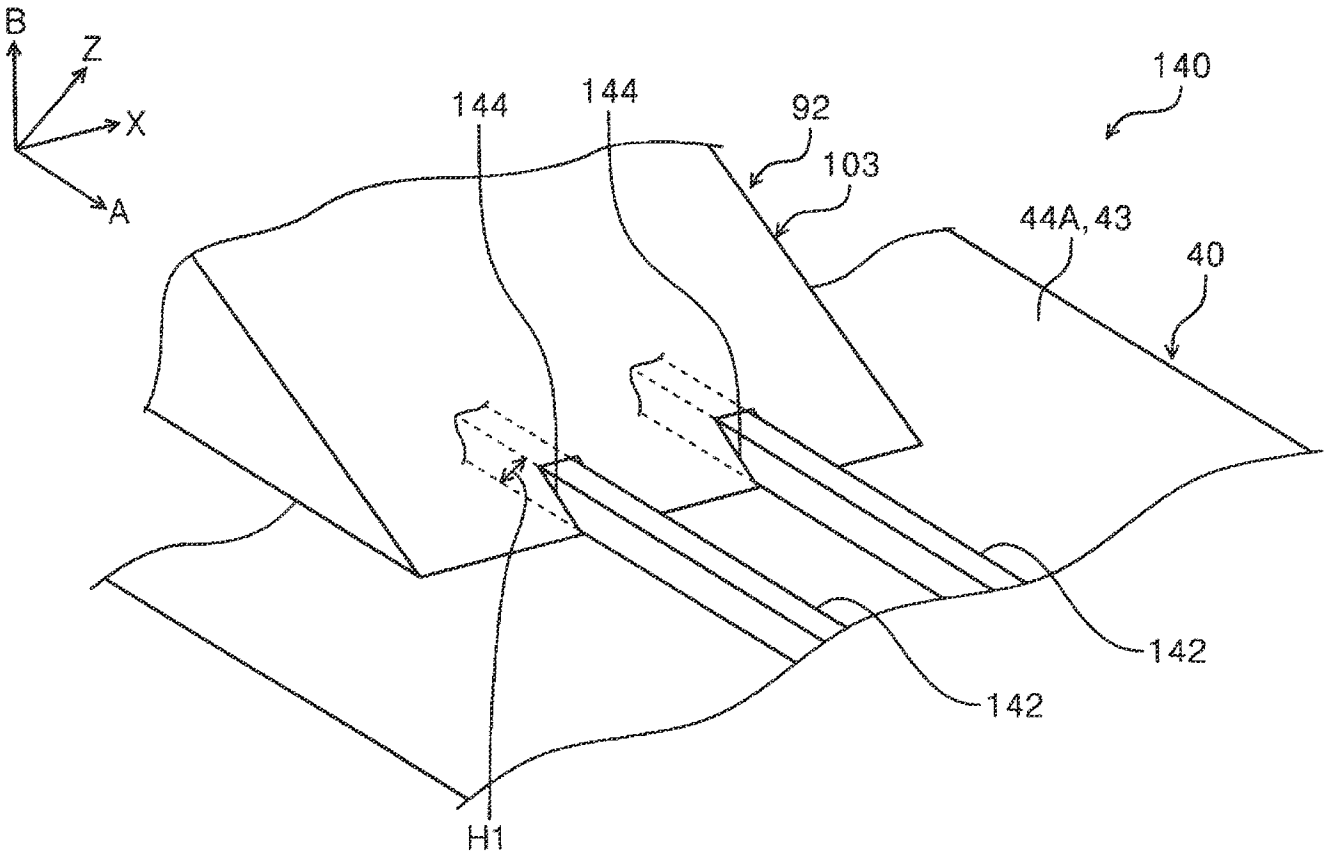
FIG. 16 is a perspective view of protruding portions of a mounting unit inserted in recessed portions of a first lower path member in a printing system according to Embodiment 3.

As illustrated in FIG. 16, the printing system 140 of Embodiment 3 has the same configuration as the printing system 1 of Embodiment 1 (FIG. 1) except that the printing system 140 has a plurality of protruding portions 142 and a plurality of recessed portions 144. The other configurations are the same as or similar to those in the printing system 1.

The plurality of protruding portions 142 are provided on the upper surface 44A of the mounting unit 40. The plurality of protruding portions 142 protrude in the +B direction from the upper surface 44A. The plurality of protruding portions 142 has, as an example, quadrangular prism shapes extending in the A direction. The plurality of protruding portions 142 are capable of supporting sheets P mounted on the protruding portions 142.

The plurality of recessed portions 144 are provided at the protrusions 103 of the first lower path member 92. Specifically, the plurality of recessed portions 144 are cutout portions at the end portions in the +A direction of the protrusions 103 and are lined in the X direction at intervals. The plurality of recessed portions 144 are open to the +A direction and the −B direction. The recessed portion 144 has a size that accommodates insertion of part in the A direction of the protruding portion 142 when the first lower path member 92 is in the second state. As mentioned above, when the first lower path member 92 is in the second state, part of the protruding portion 142 is inserted into the recessed portion 144.

Here, when viewed from the X direction, the edge of the recessed portion 144 and the protruding portion 142 overlap with each other by the height H1 in the Z direction.

Next, effects of the printing system 140 of Embodiment 3 will be described.

In the printing system 140, since the mounting unit 40 is provided with the protruding portions 142, and when the first lower path member 92 is in the second state, the protruding portions 142 are inserted in the recessed portions 144 of the first lower path member 92, the first lower path member 92 can be positioned close to the mounting unit 40. In other words, the rotation range of the first lower path member 92 is less restricted by the protruding portions 142. With this configuration, in the case of the configuration in which the first lower path member 92 comes in contact with the mounting unit 40, the space formed on the mounting unit 40 can be large.

Embodiment 4

Next, a printing system 150 of Embodiment 4 will be described with reference to the attached drawings. Portions common to those of the printing systems 1, 130, and 140 are denoted by the same symbols, and description thereof is omitted.

Figure 17:
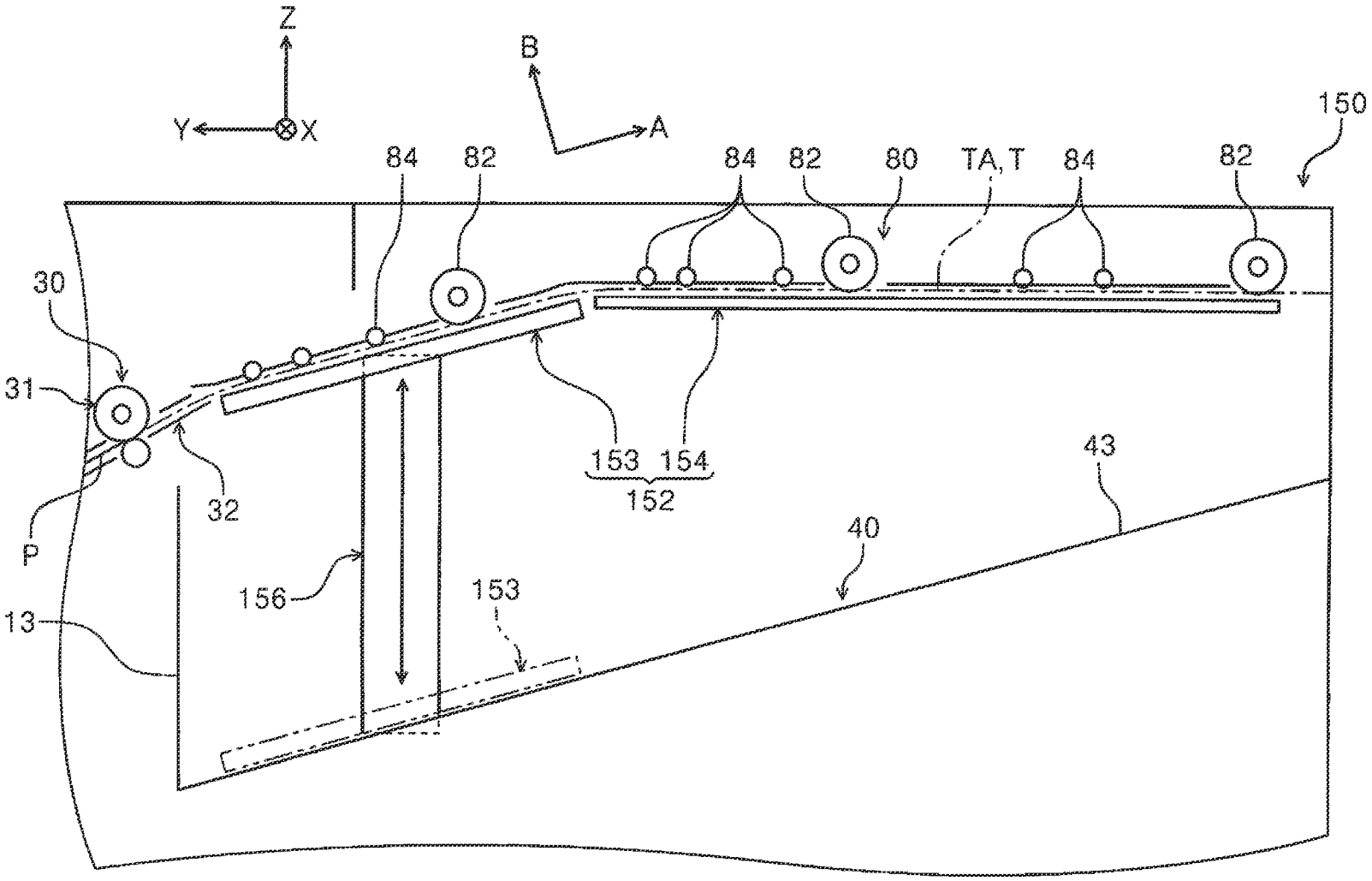
FIG. 17 is a schematic diagram illustrating a lower path member in a first state in a printing system according to Embodiment 4.

As illustrated in FIG. 17, the printing system 150 of Embodiment 4 has the same configuration as the printing system 130 of Embodiment 2 (FIG. 15) except that the printing system 150 does not have the first rotation shaft 87 and the second rotation shaft 88, has a lower path member 152 instead of the lower path member 86, and has an additional elevation unit 156. The other configurations are the same as or similar to those in the printing system 130.

The lower path member 152 includes, as an example, a first lower path member 153 and a second lower path member 154 positioned downstream in the E direction of the first lower path member 153.

The first lower path member 153 is provided to be capable of retreating in the −Z direction from the relay path TA.

When the first lower path member 153 retreats from the relay path TA, the lower path member 152 is switched from the first state to the second state.

Specifically, the first lower path member 153 has a specified thickness in the B direction and has a plate shape extending in the A direction. The first lower path member 153 is switched between the first state and the second state by the elevation unit 156 described later being driven. The first lower path member 153, in the first state, faces the inclined wall 74 and serves as part of the relay path TA. The first lower path member 153, in the second state in which the first lower path member 153 retreats in the −Z direction from the relay path TA, is on the mounting unit 40.

The second lower path member 154 has a plate shape having a specified thickness in the Z direction. The second lower path member 154, as an example, faces the upper wall 76 and is fixed in the state in which the second lower path member 154 serves as part of the relay path TA.

The elevation unit 156 includes, as an example, a not-illustrated linear slider. The elevation unit 156 has a not-illustrated moving portion that, when turned on, rises in the +Z direction or descends in the −Z direction. The first lower path member 153 is attached to the moving portion.

Next, effects of the printing system 150 of Embodiment 4 will be described.

In the printing system 150, the lower path member 152 is divided into the first lower path member 153 and the second lower path member 154. Here, since the first lower path member 153 can retreat from the relay path TA, when a sheet P transportation error occurs in the middle of the relay path TA, the sheet P can be taken out easily at the lower path member 152 by making the first lower path member 153 retreat from the relay path TA.

The printing systems according to the embodiments and modification examples of the present disclosure are based on the configurations as described above, but it is possible, as a matter of course, to make change, elimination, combination or the like in part of the configurations within the scope not departing from the spirit of the disclosure of the present application.

First Modification Example

Figure 18:
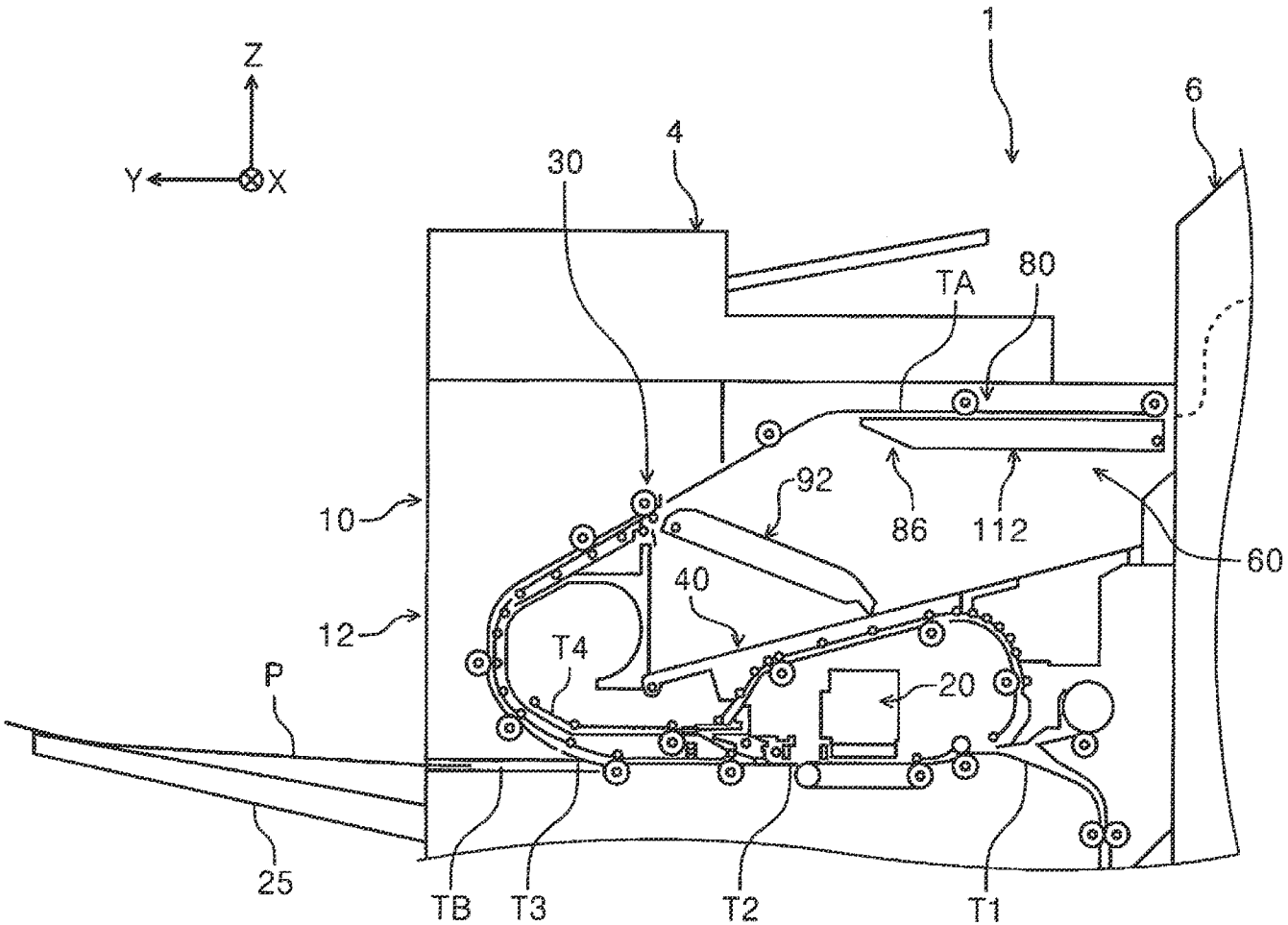
FIG. 18 is a configuration diagram illustrating part of a printing system according to a first modification example of Embodiment 1.

FIG. 18 illustrates a configuration of a first modification example of the printing system 1 in which the apparatus body 12 has a shelter path TB and a shelter tray 25. The shelter path TB branches off part of the transportation path T and extends to the end portion in the +Y direction of the apparatus body 12. The shelter tray 25 receives sheets P discharged from the shelter path TB.

In the first modification example of the printing system 1, when the operation of the post-process unit 6 stops, and the number of the sheets P mounted on the mounting unit 40 exceeds the set number in the state in which the sheet P is discharged from the discharging unit 30 via the relay unit 60 to the mounting unit 40, the sheet P is discharged to the shelter tray 25 via the shelter path TB. This configuration prevents sheets P from being discharged to the mounting unit 40 in more than the allowable degree.

Second Modification Example

Figure 19:
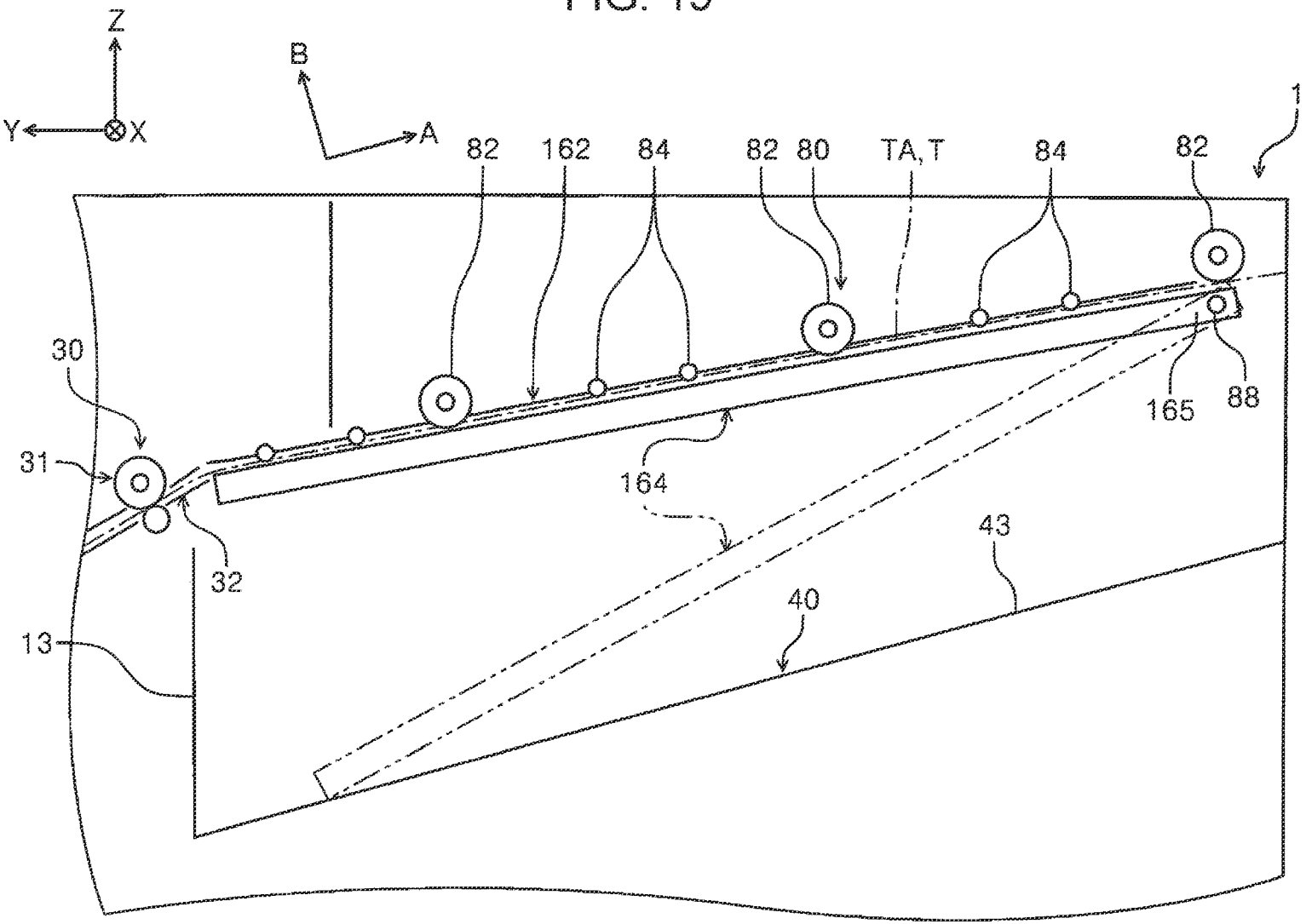
FIG. 19 is a schematic diagram illustrating a lower path member in a first state and in a second state in a printing system according to a second modification example of Embodiment 1.

FIG. 19 illustrates a configuration of a second modification example of the printing system 1 in which the upper path member 72 and the lower path member 86 (FIG. 5) are replaced with a straight upper path member 162 and a plate-shaped lower path member 164. The second modification example does not have the first rotation shaft 87 (FIG. 5).

The upper path member 162 is inclined such that the end portion in the +Y direction is positioned in the +Z direction relative to the end portion in the −Y direction.

The lower path member 164 has a specified thickness in the B direction and extends in the +A direction. The proximal end portion 165 in the +A direction of the lower path member 164 is rotated around the second rotation shaft 88. The lower path member 164 is switched between a first state in which the lower path member 164 together with the upper path member 162 serves as part of the relay path TA and a second state in which the lower path member 164 retreats in the −Z direction from the relay path TA.

In the second modification example of the printing system 1, when the lower path member 164 is in the second state, the sheet P is discharged into the space above the mounting unit 40. As described above, a configuration in which the lower path member 164 is a single member is possible.

Note that a configuration is possible in which the first rotation shaft 87 is provided instead of the second rotation shaft 88, and the proximal end portion in the −A direction of the lower path member 164 is rotated around the first rotation shaft 87. An alternative configuration is possible in which the elevation unit 156 (FIG. 17) is provided instead of the first rotation shaft 87 and the second rotation shaft 88, and the lower path member 164 is risen and descended.

Other Modification Examples

In the printing system 1, the lower path member 86 may have rollers as part of the rotation mechanism unit 80. Instead of providing the first rotation shaft 87, the first state may be switched to the second state by detaching the first lower path member 92. A configuration without the opening/closing sensor 56 is possible. Instead of the first lower path member 92 and the second lower path member 112 having the recesses 104 and 121 and the protrusions 103 and 119, the first lower path member 92 and the second lower path member 112 may be arranged to be apart from each other in the E direction. A configuration without the gently-bending unit 34 is possible. The first lower path member 92 may be positioned lower in the Z direction than the end portion in the E direction of the discharging guide 32. The discharging unit 30 may discharge the sheet P at a constant discharge speed whether the lower path member 86 is in the first state or in the second state. A configuration is possible in which the discharging unit 30 discharges the sheet P without having the determination unit 54. Instead of the configuration in which the protruding portions 142 are inserted into the recessed portions 144 provided at the protrusions 103 of the first lower path member 92, a configuration is possible in which the protruding portions 142 are inserted into the recesses 104.

As for the second lower path member 112, the state in which the second lower path member 112 serves as part of the relay path TA may be defined as a first state, and the state in which the second lower path member 112 opens the relay path TA may be defined as a second state.

What is claimed is:

1. A printing system comprising:

a discharging unit provided to an apparatus body and configured to discharge a medium printed by a printing unit;

a mounting unit provided to the apparatus body and configured to accommodate the medium discharged from the discharging unit;

a post-process unit configured to perform a post-process on the medium discharged in a discharging direction from the discharging unit;

a relay transportation unit that is provided to the apparatus body and configured to transport the medium discharged from the discharging unit, to the post-process unit and that has at least one switching member; and a control unit configured to control discharging of the medium from the discharging unit, wherein the switching member is disposed above the mounting unit, the switching unit being configured to be switched between a first state in which the switching member serves as part of a relay path of the medium from the discharging unit to the post-process unit and a second state in which the switching member opens the relay path to the mounting unit, and the control unit, when the switching member is in the second state, makes the medium be discharged from the discharging unit to the mounting unit.

2. The printing system according to claim 1, wherein the relay transportation unit includes an upper path member configured to serve as an upper portion, in an apparatus height direction, of the relay path, and a lower path member configured to serve as a lower portion, in the apparatus height direction, of the relay path and configured to serve as the switching member, the upper path member is provided with a rotation mechanism unit that is driven to rotate and thereby transports the medium, and the lower path member is not provided with the rotation mechanism unit.

3. The printing system according to claim 2, wherein the relay transportation unit includes a first rotation shaft that extends in a medium width direction intersecting both the discharging direction and the apparatus height direction, the first rotation shaft supports the lower path member such that the lower path member is rotatable, and the lower path member is switched between the first state and the second state by being rotated around the first rotation shaft.

4. The printing system according to claim 3, wherein the lower path member has a proximal end portion rotatable around the first rotation shaft, and the mounting unit is positioned outside a rotation path of a distal end portion of the lower path member which is opposite to the proximal end portion.

5. The printing system according to claim 3, wherein the mounting unit has a protruding portion that supports the medium mounted on the mounting unit, and the lower path member has a recessed portion configured to accommodate insertion of part of the protruding portion when the lower path member is in the second state.

6. The printing system according to claim 3, wherein the lower path member includes a first lower path member and a second lower path member positioned downstream, in the discharging direction, of the first lower path member, the first lower path member is configured to rotate around the first rotation shaft, and the relay transportation unit is switched between the first state and the second state by the first lower path member being rotated around the first rotation shaft.

7. The printing system according to claim 6, wherein the relay transportation unit includes a second rotation shaft that extends in the medium width direction and supports the second lower path member such that the second lower path member is rotatable, and a downstream end portion, in the discharging direction, of the second lower path member is rotatably supported by the second rotation shaft.

8. The printing system according to claim 7, wherein the second lower path member is configured to be switched by being rotated by the second rotation shaft between a closed state in which the second lower path member servers as part of the relay path and an open state in which the second lower path member opens the relay path, the printing system further includes a detection unit configured to detect the open state and the closed state, and the control unit, when the detection unit detects the open state, stops operation of discharging the medium by the discharging unit.

9. The printing system according to claim 6, wherein a recess is provided at one of a downstream end, in the discharging direction, of the first lower path member and an upstream end, in the discharging direction, of the second lower path member, a protrusion configured to be inserted in the recess is provided at the other of the downstream end, in the discharging direction, of the first lower path member and the upstream end, in the discharging direction, of the second lower path member, and when the lower path member is in the first state, at least part of the protrusion is inserted in the recess.

10. The printing system according to claim 2, wherein the lower path member includes a first lower path member and a second lower path member positioned downstream, in the discharging direction, of the first lower path member, the first lower path member is configured to retreat from the relay path, and the lower path member is switched from the first state to the second state by the first lower path member being made to retreat from the relay path.

11. The printing system according to claim 2, wherein the discharging unit includes a gently-bending unit configured to perform gently-bending operation in which the medium is deformed such that a shape of the medium is in a wavy form viewed from the discharging direction, the gently-bending unit being configured to switch whether to perform the gently-bending operation, and the gently-bending unit, when the lower path member is in the first state, does not perform the gently-bending operation on the medium and, when the lower path member is in the second state, performs the gently-bending operation on the medium.

12. The printing system according to claim 2, wherein the discharging unit includes a guide member configured to guide the medium in the discharging direction, and when a straight line extending from a distal end, in the discharging direction, of the guide member to the discharging direction is defined as an imaginary line, the lower path member is positioned lower than the imaginary line in an orthogonal direction orthogonal to the discharging direction.

13. The printing system according to claim 1, wherein an upstream end portion, in the discharging direction, of the switching member has a supporting portion that supports the medium, the supporting portion, when the switching member is in the second state, protrudes upward in an apparatus height direction of the apparatus body, and the control unit, when the switching member is in the first state, makes the discharging unit discharge the medium at a first speed and, when the switching member is in the second state, makes the discharging unit discharge the medium at a second speed higher than the first speed.

14. The printing system according to claim 1, further comprising a determination unit configured to determine whether the medium has a size, in the discharging direction, that is able to be mounted on the mounting unit, a transportation unit provided to the apparatus body and configured to transports the medium to the printing unit, wherein the control unit, when the determination unit determines that the medium has a size that is able to be mounted on the mounting unit, makes the discharging unit discharge the medium and, when the determination unit determines that the medium has a size that is not able to be mounted on the mounting unit, stops transportation of the medium by the transportation unit.

* * * * *